US012253089B2

(12) United States Patent
Suzuki

(10) Patent No.: US 12,253,089 B2
(45) Date of Patent: Mar. 18, 2025

(54) VACUUM PUMP

(71) Applicant: Edwards Japan Limited, Yachiyo (JP)

(72) Inventor: Haruki Suzuki, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 0 days.

(21) Appl. No.: 18/250,333

(22) PCT Filed: Oct. 29, 2021

(86) PCT No.: PCT/JP2021/040017
§ 371 (c)(1),
(2) Date: Apr. 24, 2023

(87) PCT Pub. No.: WO2022/097577
PCT Pub. Date: May 12, 2022

(65) Prior Publication Data

US 2023/0417250 A1 Dec. 28, 2023

(30) Foreign Application Priority Data

Nov. 4, 2020 (JP) ..... 2020-184422

(51) Int. Cl.
*F04D 19/04* (2006.01)

(52) U.S. Cl.
CPC ..... *F04D 19/044* (2013.01)

(58) Field of Classification Search
CPC ..... F04D 19/042; F04D 19/044; F04D 19/046
See application file for complete search history.

(56) References Cited

U.S. PATENT DOCUMENTS 5,695,316 A * 12/1997 Schutz ..... F04D 23/008 417/423.4
2015/0016958 A1 1/2015 Hofmann et al.
2016/0365234 A1 12/2016 Manabe

FOREIGN PATENT DOCUMENTS

JP 2005030209 A 2/2005
JP 2015017611 A 1/2015
JP 2017002783 A 1/2017

OTHER PUBLICATIONS

International Search Report and Written Opinion of International Application No. PCT/JP2021/040017 dated Jan. 11, 2022, 8 Pages.

* cited by examiner

*Primary Examiner* — Brian O Peters
(74) *Attorney, Agent, or Firm* — Shumaker & Sieffert, P.A.

(57) ABSTRACT

A vacuum pump having excellent exhaust performance is provided. The vacuum pump includes a Siegbahn type exhaust mechanism portion 201 in which a Siegbahn spiral groove portion 262 is provided in at least either rotating discs 220*a* to 220*c* or stator discs 219*a* and 219*b*, and a Holweck type exhaust mechanism portion 301 in which a thread groove 131*a* is provided in at least either a cylindrical portion 102*d* of a rotating body 103 or a threaded spacer 131, and the Holweck type exhaust mechanism portion 301 is located on the downstream side of the Siegbahn type exhaust mechanism portion 201. The Holweck type exhaust mechanism portion 301 has a flow passage depth that is continuously constant at a predetermined depth H2, and the Siegbahn type exhaust mechanism portion 201 includes a region that is continuously constant at the predetermined depth H2 from a predetermined position.

2 Claims, 12 Drawing Sheets

(a)

(b)

(a)

(b)

(a) CONVENTIONAL STRUCTURE: Inlet Pressure <GAS 1>

(b) CONVENTIONAL STRUCTURE: Inlet Pressure <GAS 2>

VACUUM PUMP

This application is a U.S. national phase application under 35 U.S.C. § 371 of international application number PCT/JP2021/040017 filed on Oct. 29, 2021, which claims the benefit of JP application number 2020-184422 filed on Nov. 4, 2020. The entire contents of each of international application number PCT/JP2021/040017 and JP application number 2020-184422 are incorporated herein by reference.

TECHNICAL FIELD

The present disclosure relates to a vacuum pump such as a turbomolecular pump.

BACKGROUND

A turbomolecular pump is commonly known as one type of vacuum pump. In a turbomolecular pump, a motor in a pump main body is energized to rotate rotor blades, which hit gaseous molecules of gas (process gas) drawn into the pump main body, thereby exhausting the gas.

Such a turbomolecular pump may be a Siegbahn type pump (PTL 1 to 3). In this Siegbahn type molecular pump, a plurality of spiral groove flow passages are formed and partitioned by ridges in a clearance between a rotating disc and a stator disc. In the Siegbahn type molecular pump, the rotating disc imparts tangential momentum to gas molecules dispersed in the spiral groove flow passages, and the spiral groove flow passages provide directivity such that the molecules tend to flow in an exhaust direction to be exhausted.

The turbomolecular pump may also be a pump of thread groove type (PTL 4). In this thread groove type turbomolecular pump, a thread groove spacer (70) and a rotor cylindrical portion (10) face each other across a predetermined clearance, and the thread groove serves as a flow passage for transporting gas.

SUMMARY

Various approaches have been devised for vacuum pumps, i.e., the various types of turbomolecular pumps as described above, to improve exhaust performance. Major indexes relating to the exhaust performance include "exhaust speed", "compression performance", and "back pressure characteristic". Of these, the "exhaust speed" is an index that simply indicates a flow rate of gas that can be exhausted per unit time. The "compression performance" is an index of how much gas can be compressed, and is relevant when the gas to be exhausted is a compressible fluid.

The "back pressure characteristic" is an index representing a degree of influence of an auxiliary pump (back pump) placed downstream of the turbomolecular pump in a vacuum exhaust system. This "back pressure characteristic" determines a limit back pressure at which the exhaust performance can be maintained.

Regarding the "back pressure characteristic", the inventor has found that, although a gas flow passage volume (gas flow passage capacity) is relevant to the limit back pressure that can maintain the exhaust performance, the limit back pressure is mainly and significantly influenced by a length of the flow passage. Thus, the inventor has come to the conclusion that a longer flow passage length for the gas to be exhausted is effective in improving the "back pressure characteristic".

An object of the present disclosure is to provide a vacuum pump having excellent exhaust performance.

(1) To achieve the above object, the present disclosure is directed to a vacuum pump comprising: a Siegbahn exhaust mechanism in which a spiral groove is provided in at least one of a rotating disc and a stator disc; and a Holweck exhaust mechanism in which a helical groove is provided in at least one of a rotating cylinder and a stator cylinder, the Holweck exhaust mechanism being located on a downstream side of the Siegbahn exhaust mechanism, wherein the Holweck exhaust mechanism has a flow passage depth that is continuously constant at a predetermined depth, and the Siegbahn exhaust mechanism includes a region that is continuously constant at the predetermined depth from a predetermined position.

(2) To achieve the above object, another aspect of the present disclosure is directed to the vacuum pump according to (1), wherein the Siegbahn exhaust mechanism is provided in plurality to be in multiple stages, and of the plurality of Siegbahn exhaust mechanisms, at least the Siegbahn exhaust mechanism in a lowest stage connected to the Holweck exhaust mechanism has a flow passage depth that is continuously constant at the predetermined depth.

(3) To achieve the above object, another aspect of the present disclosure is directed to the vacuum pump according to (1) or (2), further comprising, on an upstream side of the Siegbahn exhaust mechanism, a rotor blade including a blade row, and a stator blade located at a predetermined distance from the rotor blade in an axial direction.

According to the above disclosure, a vacuum pump having excellent exhaust performance can be provided.

BRIEF DESCRIPTION OF THE DRAWINGS

FIG. 6(*b*) is an explanatory diagram schematically showing the upstream plate surface of a downstream stator disc.

FIG. 8(*b*) is a graph showing the back pressure characteristic in a situation in which gas B of another gas type flows.

FIG. 11(*b*) is a graph showing the relationship between flow passage position and pressure also in the model of FIG. 10.

FIG. 12(*b*) is a graph showing that a backflow region is present.

FIG. 13(*b*) is a graph showing back pressure characteristic for another gas type also in the conventional structure.

DETAILED DESCRIPTION

Figure 1:
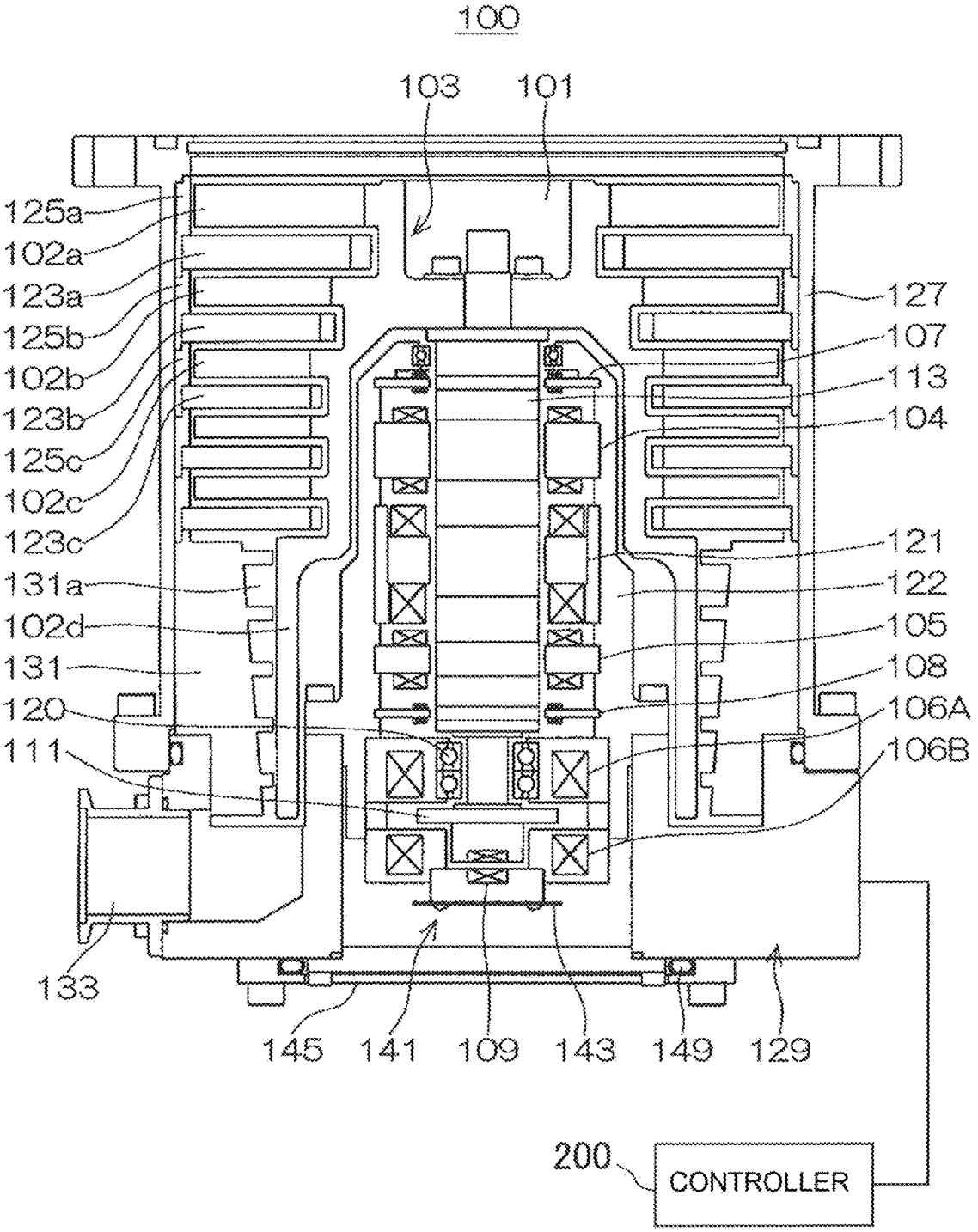
FIG. 1 is an explanatory diagram schematically showing the configuration of a turbomolecular pump according to an example of the present disclosure.

Referring to the drawings, a vacuum pump according to an example of the present disclosure is now described. FIG. 1 shows a turbomolecular pump 100 as a vacuum pump according to an example of the present disclosure. The turbomolecular pump 100 is to be connected to a vacuum chamber (not shown) of a target apparatus such as a semiconductor manufacturing apparatus.

Figure 5:
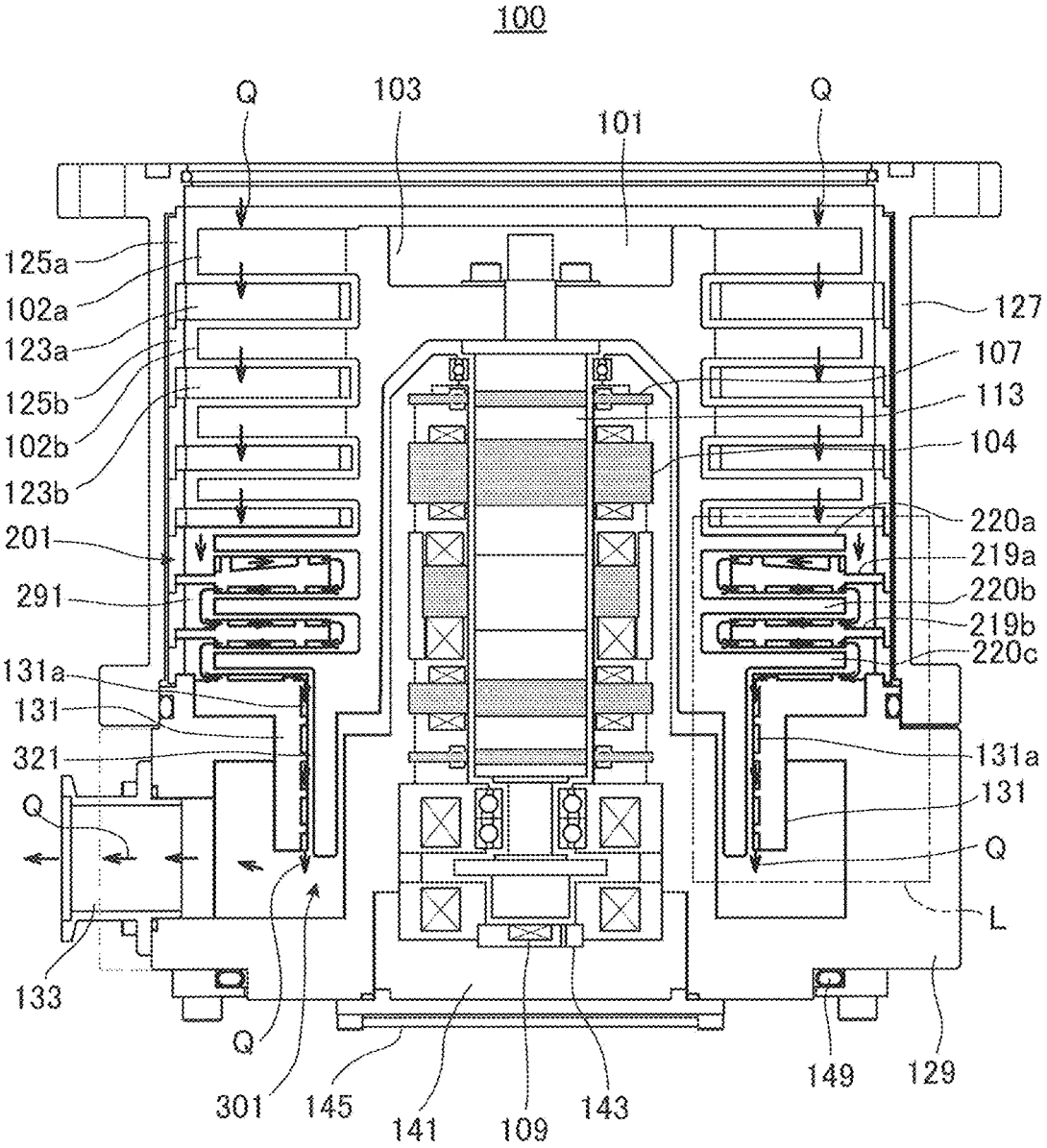
FIG. 5 is an explanatory diagram showing the specific configuration of the main part and the schematic gas flow of the turbomolecular pump of FIG. 1.

FIG. 1 is a vertical cross-sectional view of the turbomolecular pump 100. To avoid complicating the drawing, FIG. 1 schematically shows the internal structure of the turbomolecular pump 100. In particular, the turbomolecular pump 100 of this example has many major characteristic structures in a groove exhaust mechanism portion in an exhaust mechanism portion. For this reason, the illustration of the groove exhaust mechanism portion is simplified in FIG. 1, and the basic configuration from suction to exhaust of the turbomolecular pump 100 is shown. The specific structure and function of the groove exhaust mechanism portion are shown in FIG. 5 and the subsequent figures, and a detailed description of the groove exhaust mechanism portion is provided following the overall description of the turbomolecular pump 100.

As shown in FIG. 1, the turbomolecular pump 100 has a circular outer cylinder 127 having an inlet port 101 at its upper end. A rotating body 103 in the outer cylinder 127 includes a plurality of rotor blades 102 (102*a*, 102*b*, 102*c*, . . . ), which are turbine blades for gas suction and exhaustion, in its outer circumference section. The rotor blades 102 extend radially in multiple stages. The rotating body 103 has a rotor shaft 113 in its center. The rotor shaft 113 is supported and suspended in the air and position-controlled by a magnetic bearing of 5-axis control, for example.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Each upper radial sensor 107 may be an inductance sensor or an eddy current sensor having a conduction winding, for example, and detects the position of the rotor shaft 113 based on a change in the inductance of the conduction winding, which changes according to the position of the rotor shaft 113. The upper radial sensors 107 are configured to detect a radial displacement of the rotor shaft 113, that is, the rotating body 103 fixed to the rotor shaft 113, and send it to the controller 200.

In the controller 200, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) shown in FIG. 2 controls and excites the upper radial electromagnets 104 to adjust a radial position of an upper part of the rotor shaft 113.

The rotor shaft 113 may be made of a high magnetic permeability material (such as iron and stainless steel) and is configured to be attracted by magnetic forces of the upper radial electromagnets 104. The adjustment is performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has the shape of a circular disc and is provided in the lower part of the rotor shaft 113. The metal disc 111 is made of a high magnetic permeability material such as iron. An axial sensor 109 is provided to detect an axial displacement of the rotor shaft 113 and send an axial position signal to the controller 200.

In the controller 200, the compensation circuit having the PID adjustment function may generate an excitation control command signal for each of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 is thus adjusted.

As described above, the controller 200 appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. Each magnetic pole is controlled by the controller 200 so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 is detected based on a detection signal of the rotational speed sensor.

Furthermore, a phase sensor (not shown) is attached adjacent to the lower radial sensors 108 to detect the phase of rotation of the rotor shaft 113. The controller 200 detects the position of the magnetic poles using both detection signals of the phase sensor and the rotational speed sensor.

A plurality of stator blades 123 (123*a*, 123*b*, 123*c*, . . . ) are arranged slightly spaced apart (by predetermined gaps) from the rotor blades 102 (102*a*, 102*b*, 102*c*). Each rotor blade 102 (102*a*, 102*b*, 102*c*, . . . ) is inclined by a predetermined angle from a plane perpendicular to the axis of the rotor shaft 113 in order to transfer exhaust gas molecules downward through collision.

The stator blades 123 are also inclined by a predetermined angle from a plane perpendicular to the axis of the rotor shaft 113. The stator blades 123 extend inward of the outer cylinder 127 and alternate with the stages of the rotor blades 102. The outer circumference ends of the stator blades 123 are inserted between and thus supported by a plurality of layered stator blade spacers 125 (125*a*, 125*b*, 125*c*, . . . ).

The stator blade spacers 125 are ring-shaped members made of a metal, such as aluminum, iron, stainless steel, or copper, or an alloy containing these metals as components, for example. The outer cylinder 127 is fixed to the outer circumferences of the stator blade spacers 125 with a slight gap. A base portion 129 is located at the base of the outer cylinder 127. The base portion 129 has an outlet port 133 providing communication to the outside. The exhaust gas transferred to the base portion 129 through the inlet port 101 from the chamber (vacuum chamber) is then sent to the outlet port 133.

According to the application of the turbomolecular pump 100, a threaded spacer 131 may be provided between the lower part of the stator blade spacer 125 and the base portion 129. The threaded spacer 131 is a cylindrical member made of a metal such as aluminum, copper, stainless steel, or iron, or an alloy containing these metals as components. The threaded spacer 131 has a plurality of helical thread grooves 131*a* in its inner circumference surface. When exhaust gas molecules move in the rotation direction of the rotating body 103, these molecules are transferred toward the outlet port 133 in the direction of the helix of the thread grooves 131*a*. In the lowest section of the rotating body 103 below the rotor blades 102 (102*a*, 102*b*, 102*c*, . . . ) (more specifically, below rotating discs 220*a* to 220*c* of a Siegbahn type exhaust mechanism portion 201 described below), a cylindrical portion 102*d* extends downward. The outer circumference surface of the cylindrical portion 102*d* is cylindrical and projects toward the inner circumference surface of the threaded spacer 131. The outer circumference surface is adjacent to but separated from the inner circumference surface of the threaded spacer 131 by a predetermined gap. The exhaust gas transferred to the thread groove 131*a* by the rotor blades 102 and the stator blades 123 is guided by the thread groove 131*a* to the base portion 129.

The base portion 129 is a disc-shaped member forming the base section of the turbomolecular pump 100, and is generally made of a metal such as iron, aluminum, or stainless steel. The base portion 129 physically holds the turbomolecular pump 100 and also serves as a heat conduction path. As such, the base portion 129 is preferably made of rigid metal with high thermal conductivity, such as iron, aluminum, or copper.

In this configuration, when the motor 121 drives and rotates the rotor blades 102 together with the rotor shaft 113, the interaction between the rotor blades 102 and the stator blades 123 causes the suction of exhaust gas from the chamber through the inlet port 101. The exhaust gas taken through the inlet port 101 moves between the rotor blades 102 and the stator blades 123 and is transferred to the base portion 129. At this time, factors such as the friction heat generated when the exhaust gas comes into contact with the rotor blades 102 and the conduction of heat generated by the motor 121 increase the temperature of the rotor blades 102. This heat is conducted to the stator blades 123 through radiation or conduction via gaseous molecules of the exhaust gas, for example.

The stator blade spacers 125 are joined to each other at the outer circumference portion and conduct the heat received by the stator blades 123 from the rotor blades 102, the friction heat generated when the exhaust gas comes into contact with the stator blades 123, and the like to the outside.

In the above description, the threaded spacer 131 is provided at the outer circumference of the cylindrical portion 102*d* of the rotating body 103, and the thread groove 131*a* is engraved in the inner circumference surface of the threaded spacer 131. However, this may be inversed in some cases, and a thread groove may be engraved in the outer circumference surface of the cylindrical portion 102*d*, while a spacer having a cylindrical inner circumference surface may be arranged around the outer circumference surface.

According to the application of the turbomolecular pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 may be maintained at a predetermined pressure by purge gas.

In this case, the base portion 129 has a pipe (not shown) through which the purge gas is introduced. The introduced purge gas is sent to the outlet port 133 through gaps between a protective bearing 120 and the rotor shaft 113, between the rotor and the stator of the motor 121, and between the stator column 122 and the inner circumference cylindrical portion of the rotor blade 102.

The turbomolecular pump 100 requires the identification of the model and control based on individually adjusted unique parameters (for example, various characteristics associated with the model). To store these control parameters, the turbomolecular pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 is housed under a rotational speed sensor (not shown) near the center, for example, of the base portion 129, which forms the lower part of the turbomolecular pump 100, and is closed by an airtight bottom lid 145.

Some process gas introduced into the chamber in the manufacturing process of semiconductors has the property of becoming solid when its pressure becomes higher than a predetermined value or its temperature becomes lower than a predetermined value. In the turbomolecular pump 100, the pressure of the exhaust gas is lowest at the inlet port 101 and highest at the outlet port 133. When the pressure of the process gas increases beyond a predetermined value or its temperature decreases below a predetermined value while the process gas is being transferred from the inlet port 101 to the outlet port 133, the process gas is solidified and adheres and accumulates on the inner side of the turbomolecular pump 100.

For example, when $SiCl_4$ is used as the process gas in an Al etching apparatus, according to the vapor pressure curve, a solid product (for example, $AlCl_3$) is deposited at a low vacuum (760 [torr] to $10^{-2}$ [torr]) and a low temperature (about 20 [° C.]) and adheres and accumulates on the inner side of the turbomolecular pump 100. When the deposit of the process gas accumulates in the turbomolecular pump 100, the accumulation may narrow the pump flow passage and degrade the performance of the turbomolecular pump 100. The above-mentioned product tends to solidify and adhere in areas with higher pressures, such as the vicinity of the outlet port 133 and the vicinity of the threaded spacer 131.

To solve this problem, conventionally, a heater or annular water-cooled tube 149 (not shown) is wound around the outer circumference of the base portion 129, and a temperature sensor (e.g., a thermistor, not shown) is embedded in the base portion 129, for example. The signal of this temperature sensor is used to perform control to maintain the temperature of the base portion 129 at a constant high temperature (preset temperature) by heating with the heater or cooling with the water-cooled tube 149 (hereinafter referred to as TMS (temperature management system)).

Figure 2:
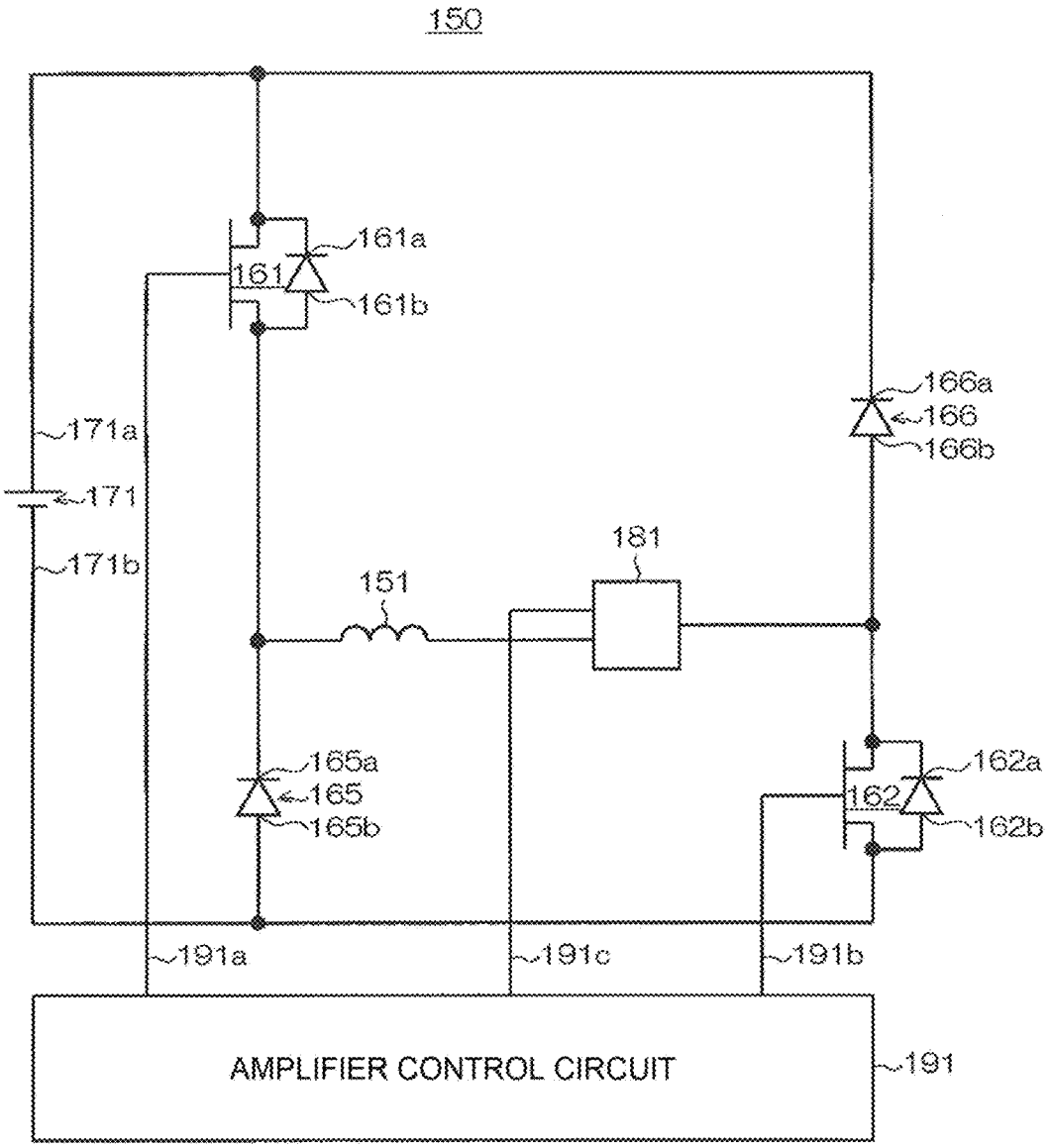
FIG. 2 is a circuit diagram of an amplifier circuit.

The amplifier circuit 150 is now described that controls and excites the upper radial electromagnets 104, the lower radial electromagnets 105, and the axial electromagnets 106A and 106B of the turbomolecular pump 100 configured as described above. FIG. 2 is a circuit diagram of the amplifier circuit 150.

In FIG. 2, one end of an electromagnet winding 151 forming an upper radial electromagnet 104 or the like is connected to a positive electrode 171*a* of a power supply 171 via a transistor 161, and the other end is connected to a negative electrode 171*b* of the power supply 171 via a current detection circuit 181 and a transistor 162. Each transistor 161, 162 is a power MOSFET and has a structure in which a diode is connected between the source and the drain thereof.

In the transistor 161, a cathode terminal 161*a* of its diode is connected to the positive electrode 171*a*, and an anode terminal 161*b* is connected to one end of the electromagnet winding 151. In the transistor 162, a cathode terminal 162*a* of its diode is connected to a current detection circuit 181, and an anode terminal 162*b* is connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing uses 5-axis control and has ten electromagnets 104, 105, 106A, and 106B in total, an identical amplifier circuit 150 is configured for each of the electromagnets. These ten amplifier circuits 150 are connected to the power supply 171 in parallel.

An amplifier control circuit 191 may be formed by a digital signal processor portion (not shown, hereinafter referred to as a DSP portion) of the controller 200. The amplifier control circuit 191 switches the transistors 161 and 162 between on and off.

The amplifier control circuit 191 is configured to compare a current value detected by the current detection circuit 181 (a signal reflecting this current value is referred to as a current detection signal 191*c*) with a predetermined current command value. The result of this comparison is used to determine the magnitude of the pulse width (pulse width time Tp1, Tp2) generated in a control cycle Ts, which is one cycle in PWM control. As a result, gate drive signals 191*a* and 191*b* having this pulse width are output from the amplifier control circuit 191 to gate terminals of the transistors 161 and 162.

Under certain circumstances such as when the rotational speed of the rotating body 103 reaches a resonance point during acceleration, or when a disturbance occurs during a constant speed operation, the rotating body 103 may require positional control at high speed and with a strong force. For this purpose, a high voltage of about 50 V, for example, is used for the power supply 171 to enable a rapid increase (or decrease) in the current flowing through the electromagnet winding 151. Additionally, a capacitor is generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current is maintained. Passing the freewheeling current through the amplifier circuit 150 in this manner reduces the hysteresis loss in the amplifier circuit 150, thereby limiting the power consumption of the entire circuit to a low level. Moreover, by controlling the transistors 161 and 162 as described above, high frequency noise, such as harmonics, generated in the turbomolecular pump 100 can be reduced. Furthermore, by measuring this freewheeling current with the current detection circuit 181, the electromagnet current iL flowing through the electromagnet winding 151 can be detected.

Figure 3:
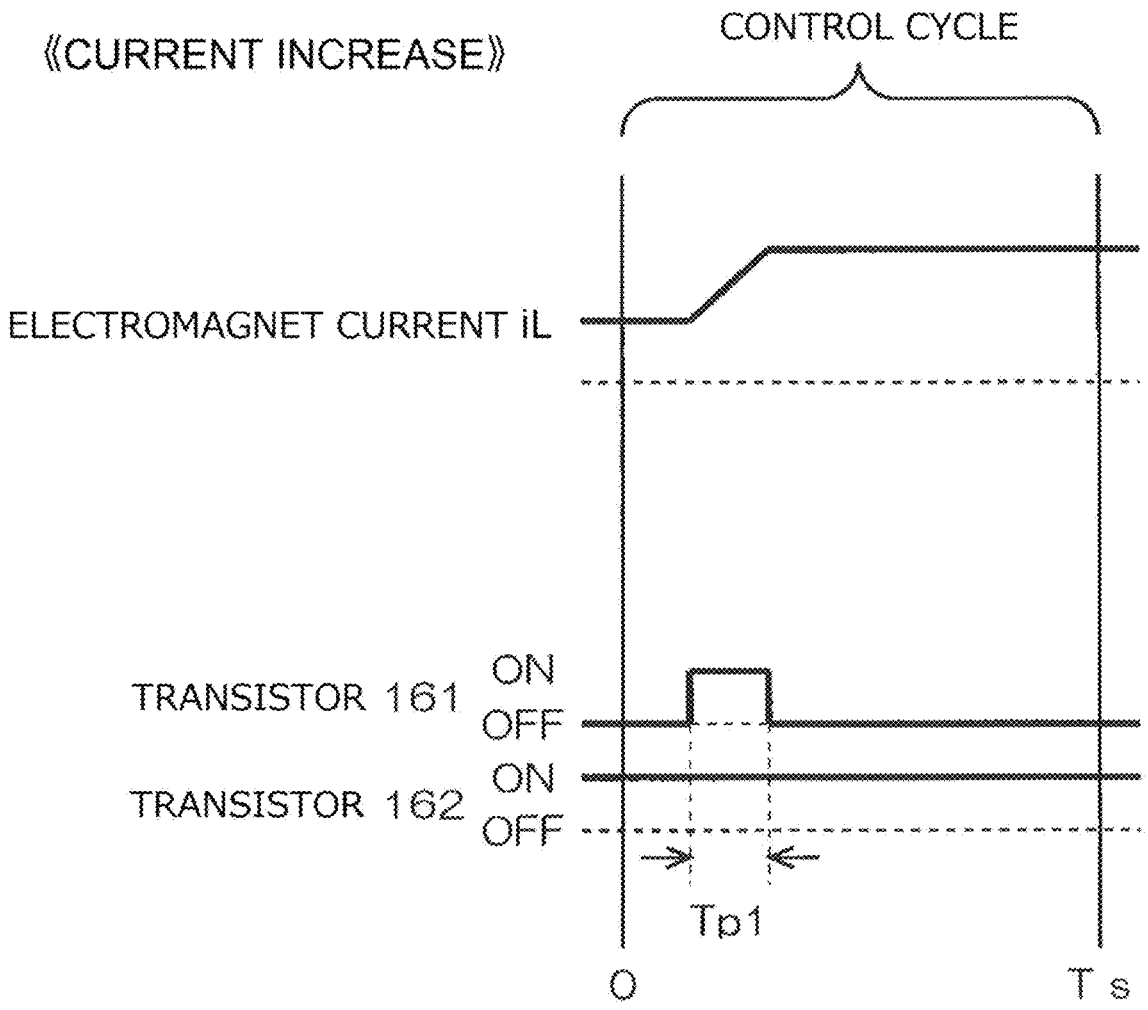
FIG. 3 is a time chart showing control performed when a current command value is greater than a detected value.

That is, when the detected current value is smaller than the current command value, as shown in FIG. 3, the transistors 161 and 162 are simultaneously on only once in the control cycle Ts (for example, 100 μs) for the time corresponding to the pulse width time Tp1. During this time, the electromagnet current iL increases accordingly toward the current value iLmax (not shown) that can be passed from the positive electrode 171*a* to the negative electrode 171*b* via the transistors 161 and 162.

Figure 4:
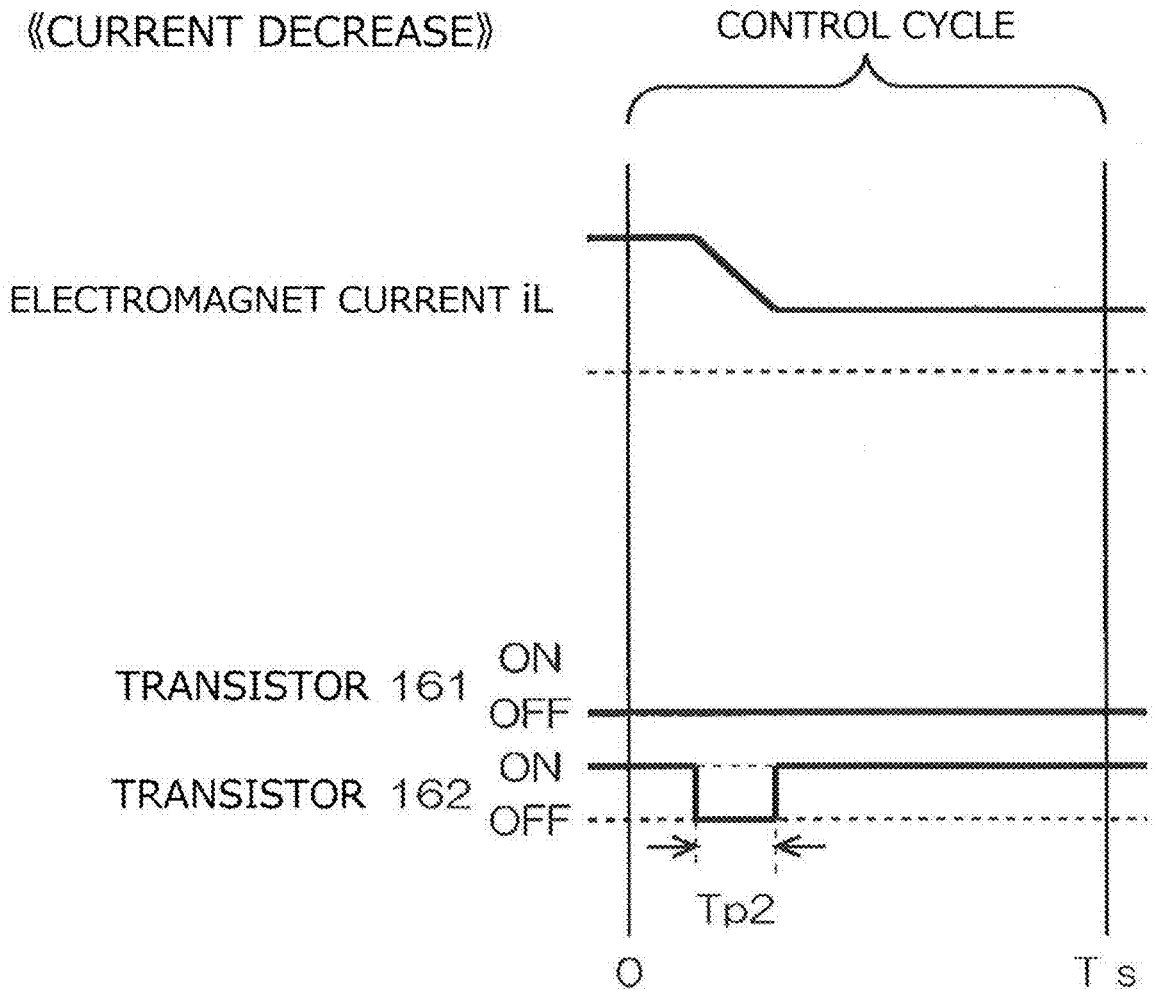
FIG. 4 is a time chart showing control performed when a current command value is less than a detected value.

When the detected current value is larger than the current command value, as shown in FIG. 4, the transistors 161 and 162 are simultaneously off only once in the control cycle Ts for the time corresponding to the pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after the pulse width time Tp1, Tp2 has elapsed, one of the transistors 161 and 162 is on. During this period, the freewheeling current is thus maintained in the amplifier circuit 150.

In the turbomolecular pump 100 with the basic configuration described above, the upper side as viewed in FIG. 1 (the side including the inlet port 101) serves as a suction portion connected to the target apparatus, and the lower side (the side including the base portion 129 in which the outlet port 133 protrudes leftward as viewed in the figure) serves as an exhaust portion connected to an auxiliary pump (a roughing back pump) or the like (not shown). The turbomolecular pump 100 can be used not only in an upright position in the vertical direction shown in FIG. 1, but also in an inverted position, a horizontal position, and an inclined position.

Also, in the turbomolecular pump 100, the above-mentioned outer cylinder 127 and the base portion 129 are combined to form a single case (hereinafter, they may be collectively referred to as a "main body casing" or the like). The turbomolecular pump 100 is electrically (and structurally) connected to a box-shaped electrical case (not shown), and the above-mentioned controller 200 is incorporated in the electrical case.

The configuration within the main body casing (the combination of the outer cylinder 127 and the base portion 129) of the turbomolecular pump 100 may be divided into a rotation mechanism portion, which rotates the rotor shaft 113 and the like with the motor 121, and an exhaust mechanism portion, which is rotationally driven by the rotation mechanism portion. The exhaust mechanism portion may be divided into a turbomolecular pump mechanism portion, which includes the rotor blades 102, the stator blades 123, and the like, and a groove exhaust mechanism portion (described below), which includes the cylindrical portion 102*d*, the threaded spacer 131, and the like.

The above-mentioned purge gas (protection gas) is used to protect components such as the bearing portions and the rotor blades 102, prevents corrosion caused by the exhaust gas (process gas), and cools the rotor blades 102, for example. This purge gas may be supplied by a general technique.

For example, although not illustrated, a purge gas flow passage extending linearly in the radial direction may be provided in a predetermined section of the base portion 129 (for example, at a position approximately 180 degrees apart from the outlet port 133). The purge gas may be supplied to the purge gas flow passage (specifically, a purge port serving as a gas inlet) from the outside of the base portion 129 via a purge gas cylinder (e.g., N2 gas cylinder), a flow rate regulator (valve device), or the like.

The protective bearing 120 described above is also referred to as a "touchdown (T/D) bearing", a "backup bearing", or the like. In case of any trouble such as trouble in the electrical system or entry of air, the protective bearing 120 prevents a significant change in the position and orientation of the rotor shaft 113, thereby limiting damage to the rotor blades 102 and surrounding portions.

In the figures showing the structure of the turbomolecular pump 100 (such as FIGS. 1 and 5), hatch patterns indicating cross sections of components are omitted to avoid complicating the drawing.

The above-described groove exhaust mechanism portion is now described with reference to FIG. 5 and the subsequent figures. FIG. 5 shows the same turbomolecular pump 100 schematically shown in FIG. 1 but, unlike FIG. 1, specifically shows the groove exhaust mechanism portion (formed by a Siegbahn type exhaust mechanism portion 201 and a Holweck type exhaust mechanism portion 301) and its surrounding portion in order to illustrate the specific structure and the function of the groove exhaust mechanism portion, as described above.

Figure 6:
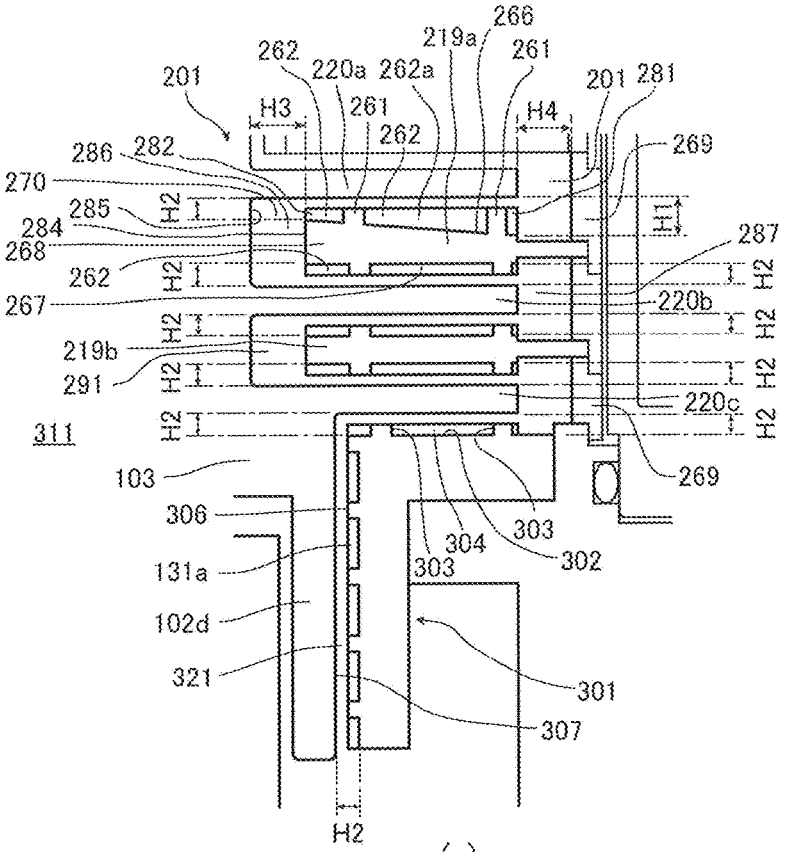
FIG. 6(*a*) is an enlarged vertical cross-sectional view of a section in the frame L of the dashed double-dotted line in FIG. 5.
Figure 6:
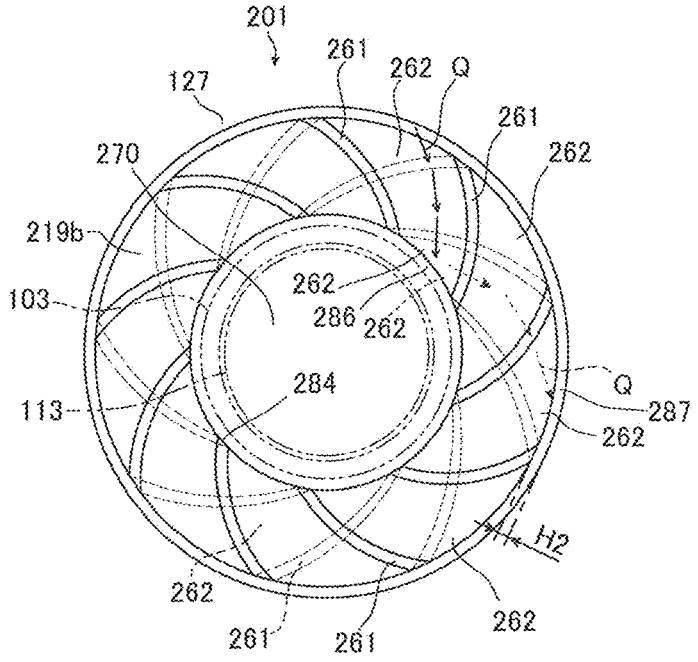
Figure 7:
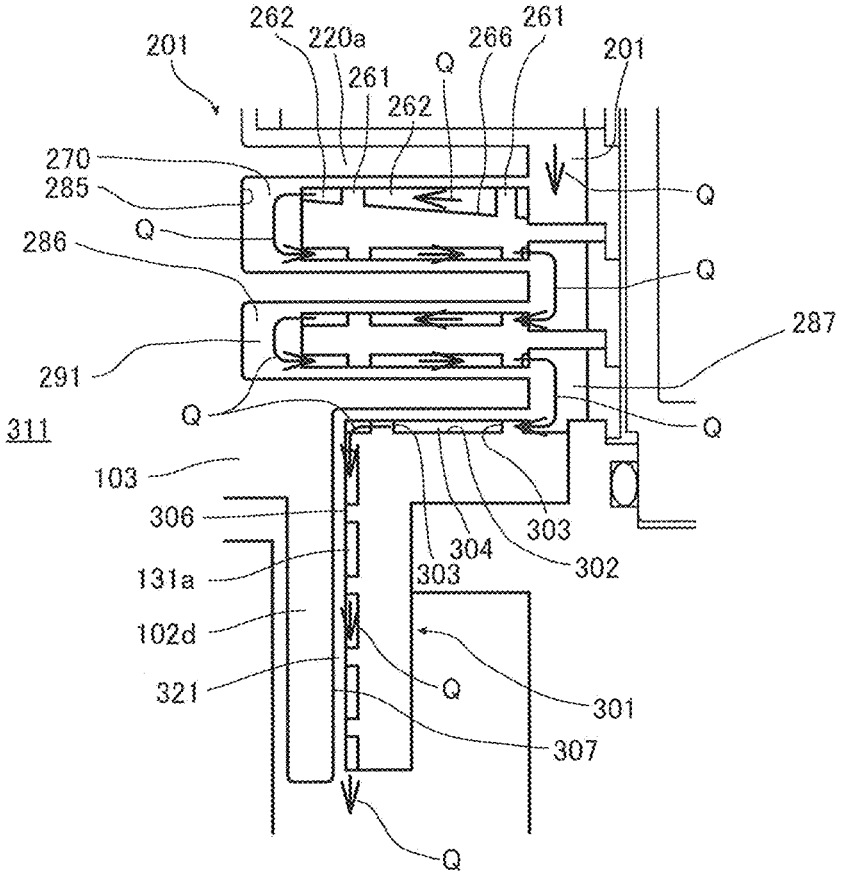
FIG. 7 is an explanatory diagram schematically showing a gas flow in the section in the frame L of the dashed double-dotted line in FIG. 5.

As shown in FIGS. 5 and 6(*a*), the groove exhaust mechanism portion of the present example includes a Siegbahn type exhaust mechanism portion 201 and a Holweck type exhaust mechanism portion 301. Of these, the Siegbahn type exhaust mechanism portion 201 is in the stage following (immediately downstream of) the turbomolecular pump mechanism portion, which includes the above-described rotor blades 102 (102*a*, 102*b*, 102*c*, . . . , each including blade row) and the stator blades 123 (123*a*, 123*b*, 123*c*, . . . ) for example, and is formed to be spatially continuous with the turbomolecular pump mechanism portion. The Holweck type exhaust mechanism portion 301 is in the stage following (immediately downstream of) the Siegbahn type exhaust mechanism portion 201 and formed to be spatially continuous with the Siegbahn type exhaust mechanism portion 201.

The Siegbahn type exhaust mechanism portion 201 is formed such that gas is transferred in the radial directions with respect to the axis of the rotor shaft 113. In contrast, the Holweck type exhaust mechanism portion 301 is formed such that gas is mainly transferred in the axial direction of the rotor shaft 113.

The Holweck type exhaust mechanism portion 301 of the present example is configured to transfer gas in the radial direction with respect to the axis of the rotor shaft 113 and to transfer gas in the axial direction of the rotor shaft 113. However, the section that transfers gas in the radial direction may be classified as a part of the Siegbahn type exhaust mechanism portion 201, and only the section that transfers gas in the axial direction of the rotor shaft 113 may be classified as the Holweck type exhaust mechanism portion 301. Details of the Holweck type exhaust mechanism portion 301 according to the present example will be described below.

The above-mentioned Siegbahn type exhaust mechanism portion 201 is a Siegbahn type exhaust mechanism and includes stator discs 219*a* and 219*b* and rotating discs 220*a* to 220*c*. The rotating discs 220*a* to 220*c* and the stator discs 219*a* and 219*b* are made of a metal, such as aluminum, iron, stainless steel, or copper, or a metal such as an alloy containing these metals as components.

The stator discs 219*a* and 219*b* are integrally coupled to the main body casing (the combination of the outer cylinder 127 and the base portion 129). A stator disc (219*a*, 219*b*) of one stage is inserted between two stages of upper and lower rotating discs (220*a* to 220*c*) arranged in the axial direction of the rotor shaft 113.

The rotating discs 220*a* to 220*c* are formed integrally with the cylindrical rotating body 103, and rotate in the same direction as the rotor shaft 113 and the rotating body 103 as the rotating body 103 rotates. That is, the rotating discs 220*a* to 220*c* rotate integrally also with the rotor blades 102 (102*a*, 102*b*, 102*c*, . . . ).

In the present example, the Siegbahn type exhaust mechanism portion 201 has two stator discs 219*a* and 219*b* and three rotating discs 220*a* to 220*c*. Also, the stator discs 219*a* and 219*b* and the rotating discs 220*a* to 220*c* are arranged alternately in the axial direction of the rotor shaft 113 from the side including the suction portion (the side including the inlet port 101) in the order of the rotating disc 220*a*, the stator disc 219*a*, the rotating disc 220*b*, the stator disc 219*b*, and the rotating disc 220*c*.

As shown enlarged in FIG. 6(*a*), a large number of ridges 261 having a rectangular cross-sectional shape protrude between the stator discs 219*a* and 219*b* and the rotating discs 220*a* to 220*c*. Also, Siegbahn spiral groove portions 262, which are spiral groove flow passages, are formed between adjacent ridges 261.

In the following description, with reference to FIGS. 5 and 6(*a*) for example, the side including the suction portion (the side including the inlet port 101) located on the upper side as viewed in the figures may be referred to as an "upstream side", while the side including the exhaust portion (the side including the outlet port 133) on the lower side as viewed in the figures may be referred to as a "downstream side".

FIG. 6(*a*) is an enlarged view of a section on the right side of the rotor shaft 113 as viewed in FIG. 5 (inside the frame L indicated by the dashed double-dotted line) of the groove exhaust mechanism portion. The groove exhaust mechanism portion has a line-symmetrical structure (left-right symmetrical as viewed in FIG. 5) with respect to the axis of the main body casing (combination of the outer cylinder 127 and the base portion 129) or the rotor shaft 113, for example. As such, only the right section in FIG. 5 is shown enlarged here, and the illustration of the left section is omitted.

As shown in FIG. 6(*a*), each of the stator discs 219*a* and 219*b* has the above-mentioned ridges 261 formed integrally on both plate surfaces 266 and 267. In the following description, the plate surfaces 266 and 267 of the stator discs 219*a* and 219*b* are designated by the same reference numerals, and the common reference numerals (reference numerals 266 and 267 in this example) are used for the different stator discs 219*a* and 219*b*.

As for the ridges 261, regardless of the difference between the stator discs 219*a* and 219*b*, and regardless of the difference between the plate surfaces 266 and 267, all the ridges are designated by common reference numeral 261 in the description. Furthermore, in FIG. 6(*a*), to avoid complicating the drawing, reference numerals are mainly indicated for the upstream stator disc 219*a* of the stator discs 219*a* and 219*b*. The indication of the same reference numerals for the downstream stator disc 219*b* is omitted.

The stator disc 219*a*, 219*b* has a disc-shaped main body portion 268 having a through hole 270 (also shown in FIG. 6(*b*)) in the center. The upstream plate surface 266 of the upstream stator disc 219*a* as viewed in FIG. 6(*a*) is inclined toward the downstream plate surface 267 from the central side (the side including the through hole 270) toward the outer circumference side, which is the proximal end side, of the main body portion 268.

In contrast, the downstream plate surface 267 is formed to be substantially horizontal as viewed in the figure. In other words, the downstream plate surface 267 of the upstream stator disc 219*a* is formed to be substantially perpendicular to the axis of the rotor shaft 113. The thickness of the main body portion 268 of the upstream stator disc 219*a* is not constant and changes to gradually decrease from the inner circumference side, which is the central side, toward the outer circumference side, which is the proximal end side.

In contrast, the main body portion 268 of the downstream stator disc 219*b* is formed to have a substantially uniform thickness from the central side to the outer circumference side, which is the proximal end side.

As used herein, the "outer circumference side" refers to the outer side of the stator discs 219*a* and 219*b* in the normal direction (radial direction) of the main body portion 268, and the "inner circumference side" refers to the inner side in also the normal direction (radial direction) of the main body portion 268.

The outer circumference edge portions of the main body portions 268 of the stator discs 219*a* and 219*b* are processed to have a substantially uniform and equal thickness, and inserted between and supported by multiple stator disc spacers 269, which are stacked in stages.

As shown schematically in FIG. 6(*b*) in addition to FIGS. 5 and 6(*a*), each of the plate surfaces 266 and 267 of the stator discs 219*a* and 219*b* has a plurality of ridges 261 as described above. The ridges 261 are formed in a spiral shape around the center of the main body portion 268 on the plate surfaces 266 and 267 of the main body portion 268. Each ridge 261 extends along a smooth curve from the circumference edge of the through hole 270 (inner circumference edge) to the outer circumference edge (a section located near the stator disc spacers 269).

FIG. 6(*b*) generally (schematically) shows, as an example, a state of the downstream stator disc 219*b* as viewed in the axial direction from the side corresponding to the upstream plate surface 266. In FIG. 6(*b*), the ridges 261 formed on the upstream plate surface 266 are indicated by solid lines, and the ridges 261 formed on the downstream plate surface 267 are indicated by relatively thin broken lines. Also, in FIG. 6(*b*), illustration of the stator disc spacer 269 is omitted. Furthermore, in FIG. 6(*b*), the rotating body 103 and the rotor shaft 113 are indicated by imaginary lines (dashed double-dotted lines).

In each stator disc 219*a*, 219*b*, each ridge 261 protrudes from each plate surface 266, 267 of the disc-shaped main body portion 268 at a predetermined angle. In the present example, as described above, the upstream plate surface 266 of the upstream stator disc 219*a* is inclined toward the downstream plate surface 267 from the central side to the outer circumference side, which is the proximal end side, of the main body portion 268.

Accordingly, on the upstream plate surface 266 of the upstream stator disc 219*a*, the ridges 261 protrude obliquely with respect to the plate surface 266.

Additionally, on the upstream plate surface 266 of the upstream stator disc 219*a*, the ridges 261 have different protruding amounts depending on the position (phase), but their distal ends (the upper ends as viewed in FIG. 6(*a*)) reach the same height and are located on the same plane perpendicular to the axis of the rotor shaft 113.

In contrast, on the downstream plate surface 267 of the upstream stator disc 219*a* and on both the plate surfaces 266 and 267 of the downstream stator disc 219*b*, the ridges 261 protrude substantially perpendicularly with respect to the plate surfaces 266 and 267. On these three plate surfaces 267, 266, and 267, the protruding amounts of the ridges 261 are substantially uniform regardless of the position (phase).

In the present example, to avoid complicating the description, the plate surfaces 266 and 267 each have nine ridges. However, the number of ridges is not limited to this, and may be eight or less or ten or more. Also, the stator discs 219*a* and 219*b* and the plate surfaces 266 and 267 do not have to have the same number of ridges and may have different numbers of ridges.

The above-mentioned Siegbahn spiral groove portions 262 are now described. For the Siegbahn spiral groove portions 262, regardless of the difference between the stator discs 219*a* and 219*b* and the plate surfaces 266 and 267, all the groove portions are also designated by common reference numeral 262 in the description. However, some Siegbahn spiral groove portions 262 may be designated by different reference numerals (such as 262*a*) and distinguished from other Siegbahn spiral groove portions 262 depending on the situation.

Each Siegbahn spiral groove portion 262 is spirally formed between two adjacent ridges 261 on each of the plate surfaces 266 and 267. The Siegbahn spiral groove portion 262 is partitioned and defined by the ridges 261. The Siegbahn spiral groove portions 262 are formed, together with the ridges 261, on the upstream plate surface 266 and the downstream plate surface 267 of each of the stator discs 219*a* and 219*b* so as to be mutually at the same phase, with the respective starting points (starting portions) as the origins. Each Siegbahn spiral groove portion 262 is a space having a relatively wide outer circumference side (with a wide opening width) and a relatively narrow inner circumference side (with a narrow opening width).

The rotating discs 220*a* to 220*c* are now described. In this example, the thickness of each of the rotating discs 220*a* to 220*c* is substantially uniform in the area from the central side near the rotating body 103 to the outer circumference side. Also, the rotating discs 220*a* to 220*c* have substantially the same (common) thickness. Furthermore, the protruding amounts of the rotating discs 220*a* to 220*c* from the rotating body 103 are substantially the same (common), and the end surfaces of the outer circumferences of the rotating discs 220*a* to 220*c* are aligned in the axial direction along the entire circumference.

Also, the rotating discs 220*a* to 220*c* face the distal end portions (protruding end portions) of the ridges 261 and partition the Siegbahn spiral groove portions 262 with slight gaps of about 1 mm, for example. As described above, the upstream plate surface 266 of the upstream stator disc 219*a* is inclined toward the downstream plate surface 267 from the central side to the outer circumference side, which is the proximal end side, of the main body portion 268. Each Siegbahn spiral groove portion 262 between the most upstream rotating disc 220*a* (the uppermost stage in FIG. 6(*a*)) and the upstream plate surface 266 of the upstream stator disc 219*a* is a space that gradually narrows from the outer circumference side toward the inner circumference side.

As described above, the Siegbahn spiral groove portions 262 formed on the upstream plate surface 266 of the upstream stator disc 219*a* may be designated by reference numeral 262*a* and distinguished from the other Siegbahn spiral groove portions 262 in the following description.

The depth of an opening 281 on the upstream side (outer circumference side) of each Siegbahn spiral groove portion 262*a* is defined as H1, and the depth of an opening 282 on the downstream side (inner circumference side) is defined as H2. The "depth" as used herein is the depth in the axial direction, which is the up-down direction as viewed in FIG. 6(*a*) (which coincides with the axial direction of the rotor shaft 113). These depths H1 and H2 are the distances between a plate surface (reference numeral omitted) of the rotating disc 220*a* and the upstream plate surface 266 of the stator disc 219*a* in the axial direction.

The Siegbahn spiral groove portions 262*a* form a section serving as a gas inlet of the groove exhaust mechanism portion, as will be described below. As such, the Siegbahn spiral groove portions 262*a* may be hereinafter referred to as a "groove exhaust mechanism portion inlet portion" or a "Siegbahn exhaust flow passage inlet portion."

Then, turning portions 286 and 287 are formed between the rotating discs 220*a* to 220*c* and the stator discs 219*a* and 219*b*. The turning portions 286 and 287 are sections with spatial turning structures relating to the gas flow passage.

That is, as described above, the ridges 261 and the Siegbahn spiral groove portions 262 extend from the respective origins (starting points) and are spatially continuous with one another in the same phase on both plate surfaces 266 and 267 of the stator discs 219*a* and 219*b*. Accordingly, at the inner circumference side of each of the stator discs 219*a* and 219*b*, a turning portion 286 is formed to spatially connect the Siegbahn spiral groove portions 262 on the upstream plate surface 266 to the Siegbahn spiral groove portions 262 on the downstream plate surface 267.

Additionally, at the outer circumference side of each of the rotating discs 220*a* to 220*c*, a turning portion 287 is formed to spatially connect the Siegbahn spiral groove portions 262 on the upstream plate surface (reference numeral omitted) to the Siegbahn spiral groove portions 262 on the downstream plate surface (reference numeral omitted). The Siegbahn spiral groove portions 262 and the turning portions 286 and 287 form spatially continuous gas flow passages. Hereinafter, this series of flow passages is referred to as a "Siegbahn exhaust flow passage" and designated by reference numeral 291 as shown in FIG. 6(*a*).

Regarding this Siegbahn exhaust flow passage 291, the dimension of the distance between the inner circumference end surface 284 of the stator disc 219*a*, 219*b* and the outer circumference surface 285 of the rotating body 103 is defined as depth H3. This H3 is larger than the above-mentioned H2 (the opening dimension of the opening 282 on the downstream side (inner circumference side) of the Siegbahn spiral groove portion 262*a*).

Also, the dimension of the distance between the outer circumference surface 285 of each of the rotating discs 220*a* to 220*c* and the stator disc spacers 269 is defined as depth H4. This H4 is larger than the above-mentioned H2 (the opening dimension of the opening 282 on the downstream side (inner circumference side) of the Siegbahn spiral groove portion 262*a*). Furthermore, in the present example, this H4 is set slightly smaller than the depth H3, which is the dimension of the distance between the stator discs 219*a* and 219*b* and the rotating body 103. However, H4 is not limited to this and may be set larger than H3, for example.

Also, the downstream plate surface 267 of the upstream stator disc 219*a* and the upstream plate surface (reference numeral omitted) of the second rotating disc 220*b* from the upstream side face each other and are substantially parallel. The distance (the depth of the gas flow passage) between the downstream plate surface 267 of the upstream stator disc 219*a* and the second rotating disc 220*b* is set to be the same as H2 described above from the inner circumference side to the outer circumference side (from the inlet to the outlet of the Siegbahn spiral groove portion 262).

Similarly, the upstream plate surface 266 of the downstream stator disc 219*b* and the downstream plate surface (reference numeral omitted) of the second rotating disc 220*b* from the upstream side face each other and are substantially parallel. The distance (the depth of the gas flow passage) between the upstream plate surface 266 of the downstream stator disc 219*b* and the second rotating disc 220*b* is set to be the same as H2 described above from the outer circumference side to the inner circumference side (from the inlet to the outlet of the Siegbahn spiral groove portion 262).

Similarly, the downstream plate surface 267 of the downstream stator disc 219*b* and the upstream plate surface (reference numeral omitted) of the third rotating disc 220*c* from the upstream side face each other and are substantially parallel. The distance (the depth of the gas flow passage) between the downstream plate surface 267 of the downstream stator disc 219*b* and the third rotating disc 220*c* is set to be the same as H2 described above from the inner circumference side to the outer circumference side (from the inlet to the outlet of the Siegbahn spiral groove portion 262).

That is, the depth of the flow passage of the Siegbahn exhaust flow passage 291 gradually narrows from H1 to H2 in the most upstream Siegbahn spiral groove portions 262*a* serving as the "Siegbahn exhaust flow passage inlet portion". The depth of the flow passage in the Siegbahn exhaust flow passage 291 is H2, which is a constant dimension, in each Siegbahn spiral groove portion 262 except for the turning portions 286 and 287. As such, in the Siegbahn exhaust flow passage 291, the section in which the flow passage depth is a constant value (H2) may be referred to as a "constant flow passage depth portion of the Siegbahn exhaust flow passage 291", for example.

In the present example, the value of the depth H2 of the flow passage is Ha [mm]. H2 is set to Ha [mm] for the reason described below. The term "constant" for the depth H2 means that when the unit of dimension is mm (millimeter), the dimension is the same to at least one decimal place without rounding off. As such, when the depth H2 (=Ha) is several [mm], for example, any variations within the range of less than 10% (=±0.1 [mm]) are considered as "constant".

The starting position of the above-described "constant flow passage depth portion of the Siegbahn exhaust flow passage 291" (predetermined position at which the region that is continuously constant at a predetermined depth starts) is at the end portion (inlet) on the inner circumference side between the upstream stator disc 219*a* and the second rotating disc 220*b*. The "constant flow passage depth portion of the Siegbahn exhaust flow passage 291" is the region that is continuously constant at a predetermined depth.

In the Siegbahn type exhaust mechanism portion 201 with such a structure, the rotating discs 220*a* to 220*c* rotate when the above-mentioned motor 121 is driven. Relative rotational displacement then takes place between the stator discs 219*a* and 219*b* and the rotating discs 220*a* to 220*c*. Also, as indicated by a large number of arrows Q (only some of which are designated by reference numerals) in FIGS. 5, 6(*b*), and 7, the gas transferred by the turbomolecular pump mechanism portion (including the rotor blades 102 and the stator blades 123, for example) reaches the Siegbahn type exhaust mechanism portion 201 of the groove exhaust mechanism portion.

The gas reaching the Siegbahn type exhaust mechanism portion 201 flows into the most upstream Siegbahn spiral groove portions 262*a* serving as the "Siegbahn exhaust flow passage inlet portion" and passes through the flow passage that gradually narrows in the depth direction (the axial direction of the rotor shaft 113). Then, the gas flows through the turning portions 286 and 287 and Siegbahn spiral groove portions 262 of a constant depth, and then flows into the Holweck type exhaust mechanism portion 301, which will be described below.

The direction of relative rotation between the stator discs 219*a* and 219*b* and the rotating discs 220*a* to 220*c* may be referred to as a 'tangential direction' in terms of straight line and a 'circumferential direction' in terms of curve.

The Siegbahn type exhaust mechanism portion 201 may be broken down into further details for explanation. For example, the exhaust flow passage formed between the most upstream first rotating disc 220*a* and the upstream plate surface 266 of the upstream stator disc 219*a* may be referred to as a "flow passage of a first Siegbahn type exhaust mechanism".

Also, the exhaust flow passage formed between the second rotating disc 220*b* and the downstream plate surface 267 of the upstream stator disc 219*a* may be referred to as a "flow passage of a second Siegbahn type exhaust mechanism". The exhaust flow passage formed between the second rotating disc 220*b* and the upstream plate surface 266 of the downstream stator disc 219*b* may be referred to as a "flow passage of a third Siegbahn type exhaust mechanism".

Furthermore, the exhaust flow passage formed between the third rotating disc 220*c* and the downstream plate surface 267 of the downstream stator disc 219*b* may be referred to as a "flow passage of a fourth Siegbahn type exhaust mechanism".

When the Siegbahn type exhaust mechanism is divided into multiple parts in this manner, the Siegbahn type exhaust mechanism portion 201 may be considered as having Siegbahn type exhaust mechanisms in multiple stages. In this case, the "fourth Siegbahn exhaust mechanism" is the Siegbahn exhaust mechanism in the lowest stage.

The above-mentioned Holweck type exhaust mechanism portion 301 is now described. As shown in FIGS. 5 and 6(*a*), the Holweck type exhaust mechanism portion 301 is mainly formed by the threaded spacer 131 described above. The threaded spacer 131 is a cylindrical member and has a plurality of helical thread grooves 131*a* engraved in its inner circumference surface.

The upper surface 302 of the threaded spacer 131 extends in the radial direction (the direction substantially perpendicular to the axial direction of the rotor shaft 113). The upper surface 302 of the threaded spacer 131 faces and is substantially parallel to the downstream plate surface (reference numeral omitted) of the rotating disc 220*c* in the lowest stage in the Siegbahn type exhaust mechanism portion 201.

Furthermore, on the upper surface 302 of the threaded spacer 131, ridges 303 and spiral groove portions 304 are formed in the same manner as the stator discs 219*a* and 219*b* in the Siegbahn type exhaust mechanism portion 201. Of these, the ridges 303 are formed integrally with the upper surface 302 of the threaded spacer 131 and protrude.

Furthermore, the ridges 303 are formed in a spiral shape around the center on the upper surface 302 of the threaded spacer 131. Each ridge 303 extends along a smooth curve from the circumference edge (inner circumference edge) of the threaded spacer 131 to the outer circumference edge. The ridges 303 protrude substantially perpendicularly with respect to the upper surface 302, and the protruding amounts of the ridges 261 are substantially uniform regardless of the position (phase).

The number of the ridges 303 may be nine in the same manner as the Siegbahn type exhaust mechanism portion 201, for example. However, the number of ridges 303 is not limited to this and may be eight or less or ten or more.

On the upper surface 302 of the threaded spacer 131, the above-mentioned spiral groove portions 304 are each formed between two adjacent ridges 303 in a spiral shape. Hereinafter, these spiral groove portions 304 are referred to as "Holweck spiral groove portions 304" to distinguish them from the Siegbahn spiral groove portions 262.

As with the Siegbahn spiral groove portions 262, the Holweck spiral groove portions 304 are partitioned and defined by ridges 303. Also, the Holweck spiral groove portions 304 are arranged to form, together with the ridges 303, a turning portion 287 between the Holweck spiral groove portions 304 and the downstream plate surface 267 of the downstream stator disc 219*b* of the Siegbahn type exhaust mechanism portion 201. Each Holweck spiral groove portion 304 is a space having a relatively wide outer circumference side (with a wide opening width) and a relatively narrow inner circumference side (with a narrow opening width).

The Holweck spiral groove portions 304 are also partitioned by the third rotating disc 220*c* from the upstream side in the Siegbahn type exhaust mechanism portion 201. The distance between the upper surface 302 of the threaded spacer 131 and the third rotating disc 220*c* is set to be the same as the above-mentioned H2 from the inner circumference to the outer circumference (from the inlet to the outlet of the Holweck spiral groove portion 304).

Also, in the Holweck type exhaust mechanism portion 301, the inner circumference surface 306 of the threaded spacer 131 has the helical thread grooves 131*a* described above. This inner circumference surface 306 faces the outer circumference surface 307 of the cylindrical portion 102*d* of the rotating body 103. The distance (depth) between the inner circumference surface 306 of the threaded spacer 131 and the outer circumference surface 307 of the cylindrical portion 102*d* of the rotating body 103 is constant over the entire axial length of the inner circumference surface 306 (from the upper end to the lower end of the inner circumference surface 306 as viewed in the figure). The value of the distance (depth) matches the H2 described above.

The helical thread grooves 131*a* are spatially continuous with the Holweck spiral groove portions 304. The connecting portions between the Holweck spiral groove portions 304 and the thread grooves 131*a* may be referred to as "bent portions", for example. The helical thread grooves 131*a* reach the lower end of the inner circumference surface 306, and the lower end of the inner circumference surface 306 extends to approximately the same position as the lower end of the outer circumference surface 307 of the cylindrical portion 102*d*.

That is, between the threaded spacer 131 and the rotating body 103, a gas flow passage, which has an L-shaped cross section as viewed in FIG. 6(*a*) (inverted L shape in FIG. 6(*a*)), is formed between the upper surface 302 of the threaded spacer 131 and the outer circumference surface 307 of the cylindrical portion 102*d* of the rotating body 103. This gas flow passage is hereinafter referred to as a "Holweck exhaust flow passage" and designated by reference numeral 321 as shown in FIG. 6(*a*).

The Holweck exhaust flow passage 321 is continuous with the Siegbahn exhaust flow passage 291 described above, and receives the gas that has passed through the Siegbahn exhaust flow passage 291. The Holweck exhaust flow passage 321 guides the gas received in the Holweck spiral groove portions 304 from the outer circumference side to the inner circumference side, and introduces it into the thread grooves 131*a* through the bent portions. The gas introduced in the thread grooves 131*a* is then guided to the downstream side along the thread grooves 131*a* at the rotating body 103 rotates.

The Holweck exhaust flow passage 321 has a constant depth H2. The depth H2 of the Holweck exhaust flow passage 321 matches the depth H2 of the constant flow passage depth portion of the Siegbahn exhaust flow passage 291 in the Siegbahn type exhaust mechanism portion 201 (the section excluding the Siegbahn exhaust flow passage inlet portion (Siegbahn spiral groove portions 262*a*) and the turning portions 286 and 287).

In other words, in the turbomolecular pump 100, the depth of the Holweck exhaust flow passage 321, which is the flow passage of the Holweck type exhaust mechanism portion 301, is continuously constant at a predetermined depth (H2), and the Siegbahn type exhaust mechanism portion 201 has a region that is continuously constant at the predetermined depth (H2) from a predetermined middle position (end portion of the Siegbahn exhaust flow passage inlet portion (Siegbahn spiral groove portions 262*a*)).

As described herein, the depth of the flow passage of the Siegbahn type exhaust mechanism portion 201 (Siegbahn exhaust flow passage 291) and the depth of the flow passage of the Holweck type exhaust mechanism portion 301 (Holweck exhaust flow passage 321) are constant (H2), excluding the turning portions 286 and 287 in the Siegbahn exhaust flow passage 291.

However, the depths H3 and H4 of the turning portions 286 and 287 may be narrowed to H2. In this case, the flow passage of the groove exhaust mechanism portion of the turbomolecular pump 100 has a region that is continuously constant at the predetermined depth (H2) over the entire region from a predetermined middle position (the end portion of the Siegbahn exhaust flow passage inlet portion (the Siegbahn spiral groove portions 262*a*).

Furthermore, when the Siegbahn type exhaust mechanism portion 201 is considered as having multiple stages of the first Siegbahn type exhaust mechanism to the fourth Siegbahn type exhaust mechanism as described above, of the multiple Siegbahn type exhaust mechanisms in the turbomolecular pump 100, at least the Siegbahn type exhaust mechanism in the lowest stage connected to the Holweck type exhaust mechanism portion 301 (the fourth Siegbahn type exhaust mechanism in this example) is continuously constant at the predetermined depth (H2).

In the present example, the term "Siegbahn type exhaust mechanism" may refer to a unit of a single Siegbahn spiral groove portion 262 on one plate surface 266, 267 of a stator disc 219*a*, 219*b*, and may also refer to a unit of Siegbahn spiral groove portions 262.

Additionally, the term "Siegbahn type exhaust mechanism" may also refer to an exhaust mechanism formed by a flow passage extending across both the upstream and downstream plate surfaces 266 and 267 of each stator disc 219*a*, 219*b*.

Also, in the present example, the Holweck type exhaust mechanism portion 301 is described as being configured to transfer gas in the radial direction with respect to the axis of the rotor shaft 113 and to transfer gas in the axial direction of the rotor shaft 113. The Holweck exhaust flow passage 321 is also described as having an L-shaped cross section as shown in FIG. 6(*a*) (inverted L shape in FIG. 6(*a*)).

However, the Holweck type exhaust mechanism portion 301 may include only the section that transfers gas in the axial direction of the rotor shaft 113, and the section that transfers gas in the radial direction may be classified as a part of the Siegbahn type exhaust mechanism portion 201. In this case, the Siegbahn type exhaust mechanism portion 201 may be considered as having not only the first to fourth Siegbahn type exhaust mechanisms but also a fifth Siegbahn type exhaust mechanism. In this case, the fifth Siegbahn type exhaust mechanism is the Siegbahn exhaust mechanism in the lowest stage.

Figure 8:
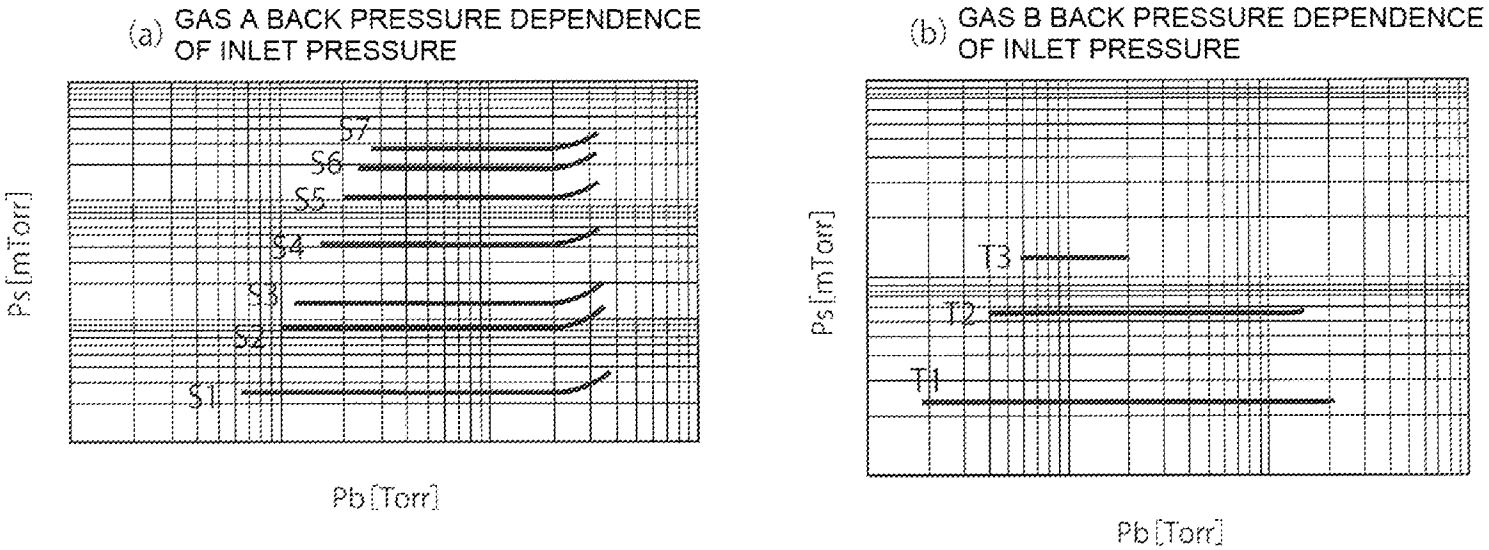
FIG. 8(*a*) is a graph showing the back pressure characteristic in a situation in which gas A of a certain gas type flows in the turbomolecular pump according to one example of the present disclosure.

The turbomolecular pump 100 of the present example described above is structured so that the flow passage depth of the Siegbahn type exhaust mechanism portion 201 and the flow passage depth of the Holweck type exhaust mechanism portion 301 are set to a common constant value (H2), thereby achieving the back pressure characteristic as shown in FIGS. 8(*a*) and 8(*b*). The back pressure characteristic of the turbomolecular pump 100 of the example is described below.

First, the indexes relating to the performance characteristics of vacuum pumps including the turbomolecular pump 100 include the above-mentioned "back pressure characteristic". The indexes relating to this "back pressure characteristic" include "back pressure dependence". This "back pressure dependence" is an index based on the relationship with the above-mentioned auxiliary pump (back pump) installed downstream of the vacuum pump, and indicates susceptibility to the back pressure (represents the back pressure characteristic from a different point of view).

More specifically, for example, when a back pump (not shown) is placed downstream of the turbomolecular pump 100, the exhaust of the turbomolecular pump 100 is performed under the influence of the exhaust performed by the back pump. Also, the performance of the back pump combined with the turbomolecular pump 100 is not uniform, and may vary depending on the selection by the user of the turbomolecular pump 100. Additionally, the exhaust of the turbomolecular pump 100 is affected by the thickness and layout of piping from the turbomolecular pump to the back pump. The compression ratio, which indicates the compression performance of the turbomolecular pump, is defined as outlet pressure/inlet pressure, and the achievable pressure at the inlet port 101 of the turbomolecular pump 100 (inlet pressure) may change with the gas pressure at the outlet port 133 of the turbomolecular pump 100 (outlet pressure).

However, as for the side including the inlet port 101 of the turbomolecular pump 100, a change in gas pressure at the inlet port 101 (inlet pressure) caused by the back pump or the like that is combined on the downstream side causes the exhaust target apparatus of the turbomolecular pump 100 to be also affected by the back pump or the like. This is not desirable.

As described above, FIGS. 8(*a*) and 8(*b*) show examples of the relationship between the outlet pressure (Pb) and the inlet pressure (Ps) of the turbomolecular pump 100 of the present example. In the graphs of FIGS. 8(*a*) and 8(*b*), the horizontal axis represents outlet pressure (Pb), and the vertical axis represents inlet pressure (Ps), both in logarithmic scales. Furthermore, the unit of the outlet pressure (Pb) is [Torr] (same as [torr] described above), and the unit of the inlet pressure (Ps) is [mTorr].

In FIGS. 8(*a*) and 8(*b*), as the back pressure characteristic, a change in the inlet pressure (Ps) on the vertical axis with respect to the outlet pressure (Pb) on the horizontal axis is referred to as the "back pressure dependence of the inlet pressure". FIG. 8(*a*) shows the back pressure dependence of the inlet pressure in a situation in which the gas being exhausted is of a certain gas type (gas A), and FIG. 8(*b*) shows the back pressure dependence of the inlet pressure in a situation in which the gas to be exhausted is of another gas type (gas B). Hereinafter, "back pressure dependence of the inlet pressure" may be simply referred to as "back pressure dependence".

In FIG. 8(*a*), reference numerals S1 to S7 indicate curves representing back pressure dependence with different flow rates. The flow rates of S1 to S7 are a predetermined flow rate of 1 sccm, a predetermined flow rate of 2 sccm, a predetermined flow rate of 3 sccm, a predetermined flow rate of 5 sccm, a predetermined flow rate of 7 sccm, a predetermined flow rate of 9 sccm, and a predetermined flow rate of 10 sccm, respectively. As for the magnitude relationship of these flow rates, the flow rate increases in the order of predetermined flow rate 1 to predetermined flow rate 10.

Reference numerals T1 to T3 in FIG. 8(*b*) also indicate the back pressure characteristic (back pressure dependence) with different flow rates. The flow rates of T1 to T3 are a predetermined flow rate of 2 sccm, a predetermined flow rate of 7 sccm, and a predetermined flow rate of 10 sccm, respectively.

In FIG. 8(*a*), assuming that the origin of the graph is a reference value (Pb=Ps=1 [Torr] in this example) for example, the curve S1 at the bottom shows that the inlet pressure (Ps) is substantially constant at a value at substantially the midpoint between the lines of 2 [Torr] and 3 [Torr] when the outlet pressure (Pb) is from 6 [Torr] to a value slightly above 200 [Torr]. Similarly, the other curves S2 to S7 show substantially constant values from the left end positions of curves S2 to S7 to positions where the outlet pressures (Pb) are slightly above 200 [Torr].

In FIG. 8(*b*), assuming that the origin of the graph is a reference value (Pb=Ps=1 [Torr] in this example) in the same manner as FIG. 8(*a*) for example, the curve T1 at the bottom shows that the inlet pressure (Ps) is substantially constant at a value exceeding 2 [Torr] when the outlet pressure (Pb) is from 2 [Torr] to around 200 [Torr]. Similarly, the other curves T2 and T3 show substantially constant values from the left end positions of curves T2 and T3 to positions where the outlet pressure (Pb) is near 200 [Torr] (for T2) or around 20 [Torr] (for T3).

That is, FIGS. 8(*a*) and 8(*b*) show the presence of outlet pressures (Pb) with which the inlet pressure (Ps) hardly changes regardless of variations of the gas type or flow rate. As such, when the range of outlet pressure (Pb) that allows the inlet pressure (Ps) to be constant and allows the curve to assume a horizontal line is larger, the inlet pressure is considered less susceptible to a change in the outlet pressure (Pb).

In other words, for example, the larger the pressure range of outlet pressure (Pb) up to the point at which a gradient starts and the inlet pressure (Ps) starts to increase as in the right end portion of each of curves S1 to S7 for gas A in FIG. 8(*a*), the smaller the possibility that the inlet pressure is affected by a change in the outlet pressure (Pb).

Figure 13:
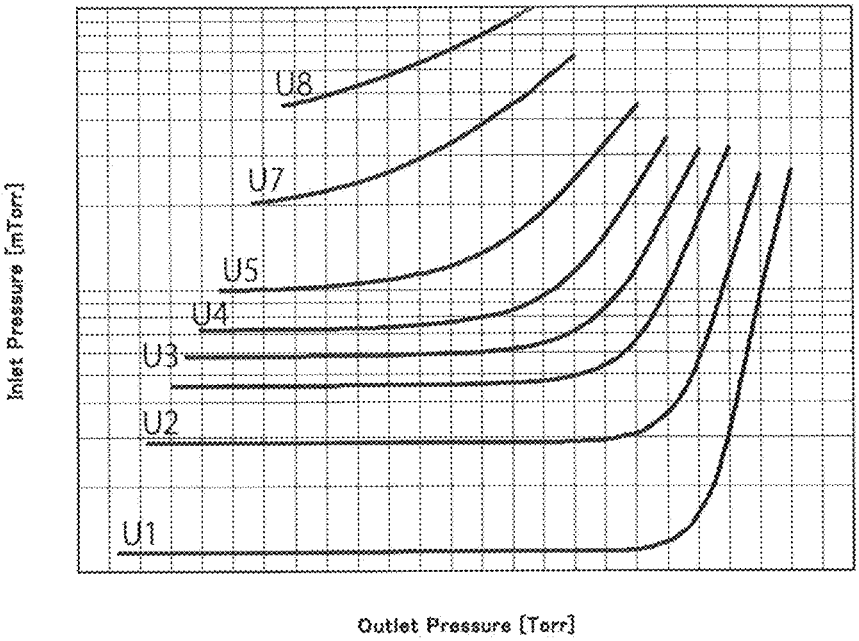
FIG. 13(*a*) is a graph showing back pressure characteristic for a certain gas type in a conventional structure.
Figure 13:
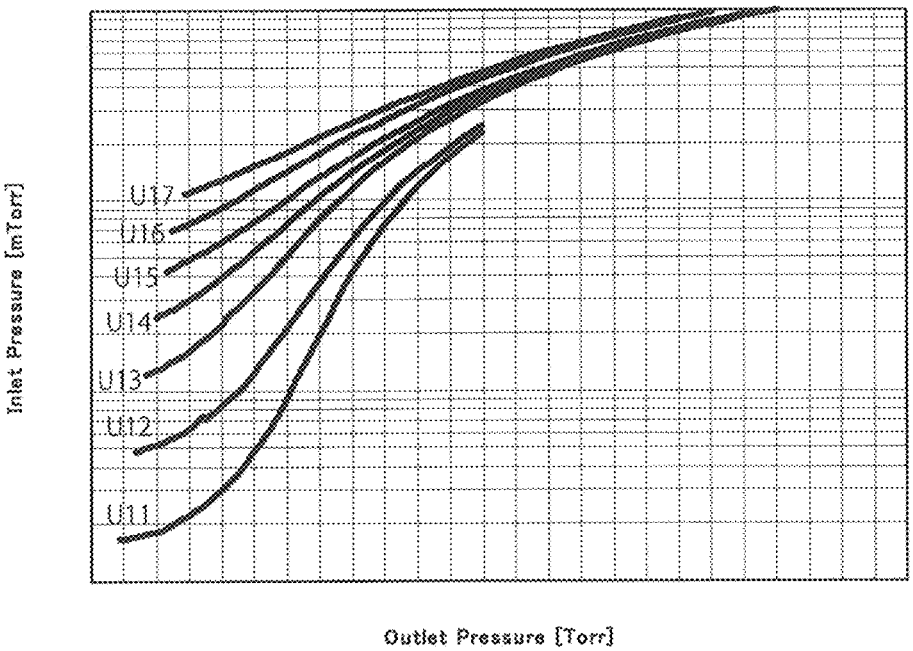

In contrast to the turbomolecular pump 100 having the structure according to the present example, FIGS. 13(*a*) and 13(*b*) show examples of the back pressure characteristic of a turbomolecular pump having a conventional structure in semi-logarithmic scales. FIGS. 13(*a*) and 13(*b*) show, as back pressure characteristic, the back pressure dependence of inlet pressure (Ps) in situations in which different gas types are used.

Of these, curves U1 to U8 in FIG. 13(*a*) indicate, for a certain gas type (gas 1), the back pressure dependence in situations in which the flow rate is a predetermined flow rate of 1 sccm, a predetermined flow rate of 3 sccm, a predetermined flow rate of 5 sccm, a predetermined flow rate of 6 sccm, a predetermined flow rate of 7 sccm, a predetermined flow rate of 8 sccm, a predetermined flow rate of 10 sccm, and a predetermined flow rate of 11 sccm in this order from the bottom in the figure. Here, predetermined flow rate 11 is a flow rate larger than predetermined flow rate 10.

Curves U11 to U17 in FIG. 13(*b*) indicate, for a certain gas type (gas 2) different from the gas type of FIG. 13(*a*), the back pressure dependence in situations in which the flow rate is a predetermined flow rate of 1 sccm, a predetermined flow rate of 2 sccm, a predetermined flow rate of 4 sccm, a predetermined flow rate of 5 sccm, a predetermined flow rate of 6 sccm, a predetermined flow rate of 7 sccm, and a predetermined flow rate of 8 sccm in this order from the bottom in the figure.

With the gas type shown in FIG. 13(*a*), the range of the substantially flat portion starting from the left end of each of curves U1 to U8 is shorter with a greater flow rate. Also, with curves U1 to U8, the outlet pressure (Pb) at which the inlet pressure starts to increase as shown in the right portion is lower with a greater flow rate.

As for the gas type shown in FIG. 13(*b*), curves U11 to U17 do not have flat portions on the graph, and the inlet pressure increases in the manner of cubic parabola as the outlet pressure increases.

That is, in the conventional structure shown in FIGS. 13(*a*) and 13(*b*), the rise of the inlet pressure (Ps) occurs with a lower outlet pressure (Pb) than in the structure used in the turbomolecular pump 100 of the present example. Also, depending on the gas type, the obtained curve may not have a flat portion.

As described above, in the conventional structure, it is difficult to obtain a back pressure characteristic (back pressure dependence in this example) that achieves a curve with a flat portion. Also, depending on the gas flow rate, it is difficult to obtain a curve of back pressure characteristic having a large flat range. However, as illustrated in FIGS. 8(*a*) and 8(*b*), the turbomolecular pump 100 of the present example can obtain a curve of back pressure characteristic having a large flat range regardless of the gas type and flow rate.

Figure 9:
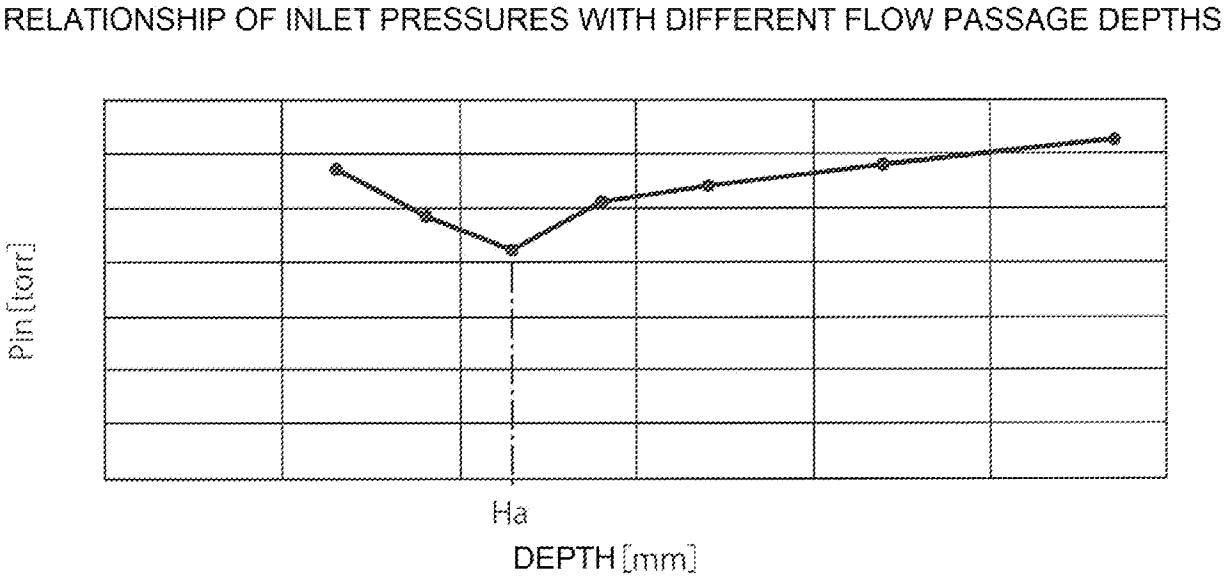
FIG. 9 is a graph showing the relationship between inlet depth and gas pressure in an experimental model of a Holweck exhaust flow passage.

In the turbomolecular pump 100 of the present example, the "predetermined depth" (=H2 (constant value)) relating to the depth of the flow passage described above is determined based on the following concept. FIG. 9 shows the relationship between the inlet depth and inlet pressure (Pin) of the thread groove exhaust mechanism.

In the turbomolecular pump 100 of the present example, the flow passage depth of the Holweck exhaust flow passage 321 is constant (H2) from the inlet to the outlet based on the concept described below. Accordingly, the "inlet depth" is equal to the flow passage depth of the continuous section from the inlet to the outlet of the Holweck exhaust flow passage 321. The relationship of "inlet depth"="outlet depth" is therefore established.

Also, the gas in the Holweck exhaust flow passage 321 is compressed while being transferred, and the "inlet depth" is preferably set so as to increase the compression efficiency in the Holweck exhaust flow passage 321. According to a simulation experiment conducted by the inventor, the "inlet depth" with which the value of the pressure Pin [Torr] on the vertical axis in FIG. 9 is low is considered as the "inlet depth" that achieves high compression efficiency.

In the simulation experiment conducted by the inventor, as shown in FIG. 9 illustrating a general tendency, the pressure Pin gradually decreased at first as the "inlet depth" of the experimental model increased. However, when the "inlet depth" value of the experimental model was set to Ha [mm], the pressure P reached the lowest point, and then the pressure P increased as the value of the "inlet depth" increased.

Based on the result of this experiment, the constant value Ha is determined to be the value with which the pressure Pin [Torr] is lowest. This Ha is used as the common depth (H2) for the entire Holweck exhaust flow passage 321 and the section of the Siegbahn exhaust flow passage 319 after the inlet portion.

The optimal constant value (H2) of the flow passage depth may vary depending on factors including the number of revolutions of the turbomolecular pump 100 during operation and the diameter dimensions of relevant components (such as the stator discs 219*a* and 219*b* and the rotating discs 220*a* to 220*c*). Thus, the optimal flow passage depth (H2) with which the peak of the exhaust performance (including compression performance) is achieved is preferably determined taking into account the above factors. The flow passage depth is usually designed in the range of at least 2 mm to 10 mm (more preferably 3 mm to 5 mm) approximately.

Figure 10:
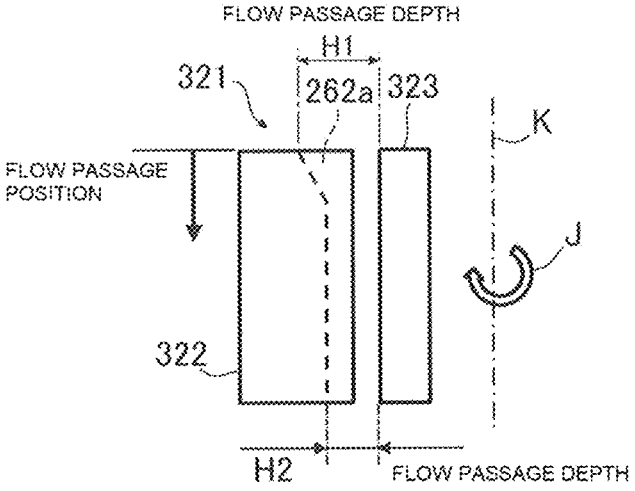
FIG. 10 is an explanatory diagram showing a modeled groove exhaust mechanism portion.

With the turbomolecular pump 100 of the present example, the reasons for the improved back pressure characteristic shown in FIGS. 8(*a*) and 8(*b*) are yet to be fully analyzed, but the following explanation may be given through the modeling shown in FIG. 10.

FIG. 10 is a diagram illustrating the characteristics of a general groove exhaust mechanism portion. In the description of the present example herein, the groove exhaust mechanism portion (FIG. 6(*a*)) of the turbomolecular pump 100 is modeled. As described above, the groove exhaust mechanism portion according to the present disclosure includes the Siegbahn type exhaust mechanism portion 201 and the Holweck type exhaust mechanism portion 301. The inlet portion of the groove exhaust mechanism portion (Siegbahn exhaust flow passage inlet portion) is formed by the Siegbahn spiral groove portions 262*a*, which narrow as they extend further into the flow passage to have the flow passage depth of H2.

In the model shown in FIG. 10, the section corresponding to the groove exhaust mechanism portion is designated by reference numeral 321, and its one end portion (upper end portion in the figure) is designated by "262*a*", which is the same reference numeral as the Siegbahn spiral groove portions that serve as the Siegbahn exhaust flow passage inlet portion, for convenience.

In the model shown in FIG. 10, reference numeral 322 indicates a stator model formed by combining and then halving the stator disc 219*a*, 219*b* forming the Siegbahn exhaust flow passage 291 and the threaded spacer 131 forming the Holweck exhaust flow passage 321. Reference numeral 323 indicates a rotating model formed by halving the rotating body 103 including the rotating discs 220*a* to 220*c* of the Siegbahn exhaust flow passage 291.

Symbol K in the figure indicates the rotation axis, and arrow J indicates that the rotating model 323 rotates around the rotation axis K. Reference numeral H1 indicates the depth (flow passage depth) of the opening 281 on the upstream side (outer circumference side) of the Siegbahn spiral groove portions 262*a*, as described above. Reference numeral H2 indicates the constant flow passage depth portion of the Siegbahn exhaust flow passage 291 described above and a constant value as the flow passage depth of the Holweck exhaust flow passage 321.

Figure 11:
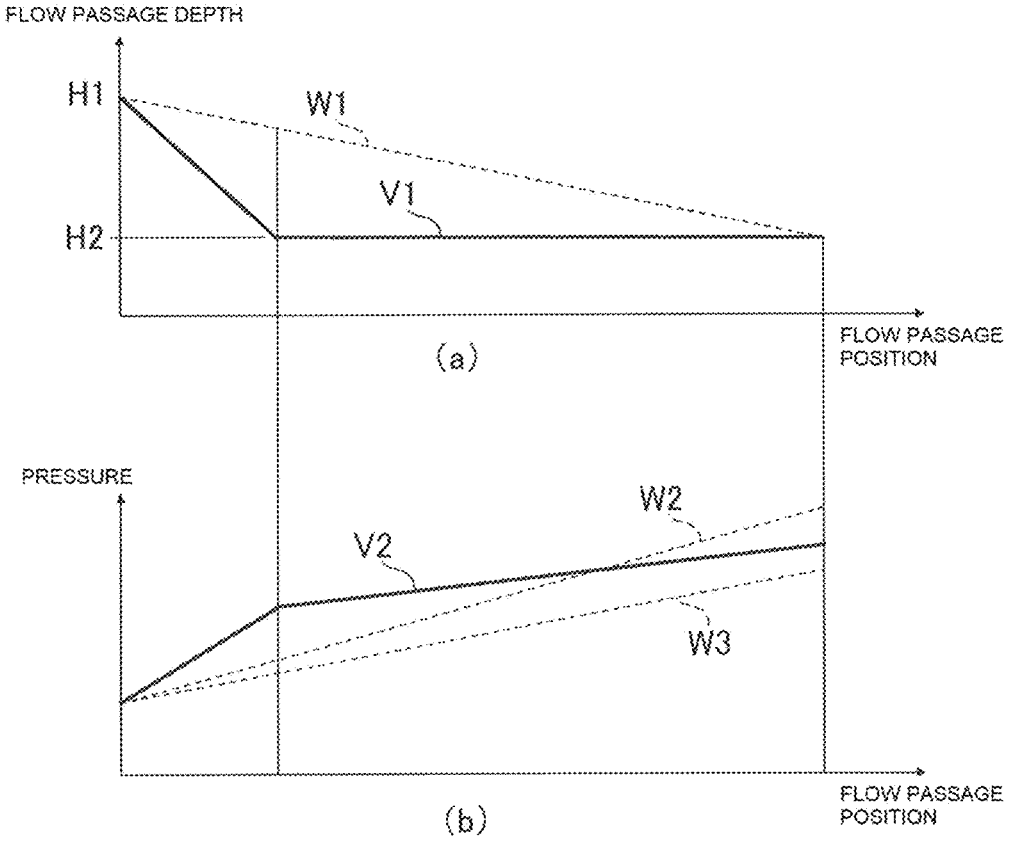
FIG. 11(*a*) is a graph schematically showing the relationship between flow passage position and flow passage depth in the model of FIG. 10.

FIGS. 11(*a*) and 11(*b*) are graphs illustrating the exhaust performance of the model shown in FIG. 10 corresponding to the flow passage depth. Of these, the horizontal axis in the graph of FIG. 11(*a*) represents "flow passage position", and the vertical axis represents "flow passage depth". The "flow passage position" on the horizontal axis represents the position in the groove exhaust mechanism portion 311. Moving the observation point from the inlet (upper end in FIG. 10) toward the outlet (lower end in FIG. 10) of the groove exhaust mechanism portion 311 is expressed here as "the flow passage position increases".

In FIG. 11(*a*), solid line V1 indicates the relationship between the flow passage position and the flow passage depth in the model shown in FIG. 10. Broken line W1 indicates the relationship between the flow passage position and the flow passage depth according to a conventional structure.

The conventional structure as used herein refers to a structure in which, as indicated by broken line W1, the flow passage depth changes slowly and gradually as the flow passage position increases so that the flow passage depth decreases. In contrast, with the model shown in FIG. 10, as the flow passage position increases in the inlet portion 262*a* (Siegbahn exhaust flow passage inlet portion) of the groove exhaust mechanism portion 311, the flow passage depth decreases sharply as compared with the conventional structure, as indicated by solid line V1.

However, when the flow passage position further increases and the observation point is positioned in the constant flow passage depth portion of the Siegbahn exhaust flow passage 291 beyond the inlet portion 262*a* of the groove exhaust mechanism portion 311, the flow passage depth becomes a constant value (H2). Then, the flow passage depth maintains the constant value (H2) even when the flow passage position increases (even in the Holweck exhaust flow passage 321).

The conventional structure in which the flow passage depth gradually decreases from the inlet to the outlet of the groove exhaust mechanism portion 311 has a potential for improving the exhaust performance such as "exhaust speed" and "compression performance". Thus, it is relatively easy to improve the exhaust performance. However, the structure may increase the possibility of gas backflow and therefore should continuously and smoothly exhaust (transfer) the incoming gas.

In contrast, by maintaining the flow passage depth constant as indicated by solid line V1 obtained by modeling the turbomolecular pump of the present example, backflow can be easily prevented with a simple design.

The horizontal axis in the graph of FIG. 11(*b*) represents "flow passage position", and the vertical axis represents "pressure". The "flow passage position" on the horizontal axis is the same as in FIG. 11(*a*). The "pressure" on the vertical axis indicates the pressure of the gas in the flow passage.

In FIG. 11(*b*), broken line W2 indicates a certain pressure change that is deemed ideal. With the pressure change indicated by broken line W2, the pressure increases at a constant rate of change as the flow passage position increases. Broken line W3 indicates a pressure change in a situation in which gas backflow described above or the like occurs and lowers the exhaust performance. With the pressure change indicated by broken line W3, the pressure increases with a gradient less steep than W2 described above as the flow passage position increases.

In contrast, solid line V2 indicates the pressure change according to the model of FIG. 10. In the model of FIG. 10, at the inlet portion of the groove exhaust mechanism portion (groove exhaust mechanism portion inlet portion, Siegbahn spiral groove portions 262*a*), as the flow passage position increases, the pressure rises sharply as compared with W2 and W3. This portion efficiently increases the degree of gas compression.

Subsequently, although the rate of change decreases, the pressure gradually increases as the flow passage position increases. When the observation point is positioned in the constant flow passage depth portion of the Siegbahn exhaust flow passage 291 beyond the inlet portion 262*a* of the groove exhaust mechanism portion 311, the flow passage depth becomes the constant value (H2). Then, the pressure at the outlet of the groove exhaust mechanism portion 311 becomes a value between W2 and W3 described above.

In other words, as in the model of FIG. 10, when the depth of the flow passage of the groove exhaust mechanism portion 311 is set constant (H2) from a middle point (a middle flow passage position), the compression performance is limited and not significantly improved. However, the backflow of gas is less likely to occur, and the pressure from the middle stage to the end stage of the groove exhaust mechanism portion 311 can be closer to W2, which is the ideal pressure.

It is clear that the compression performance can be improved by further increasing the length of the flow passage depth H2.

The region in which the flow passage depth is a constant value (H2) (constant region) is preferably determined so that gas backflow is minimized (less likely to occur) in the flow passage, even if the peak of the compression performance is not obtained.

Figure 12:
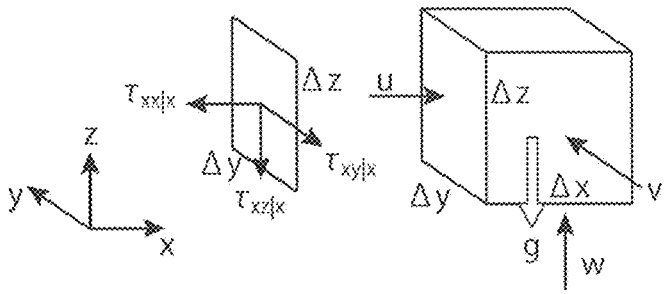
FIG. 12(*a*) is an explanatory diagram showing a general model of a Couette-Poiseuille flow between parallel flat plates.
Figure 12:
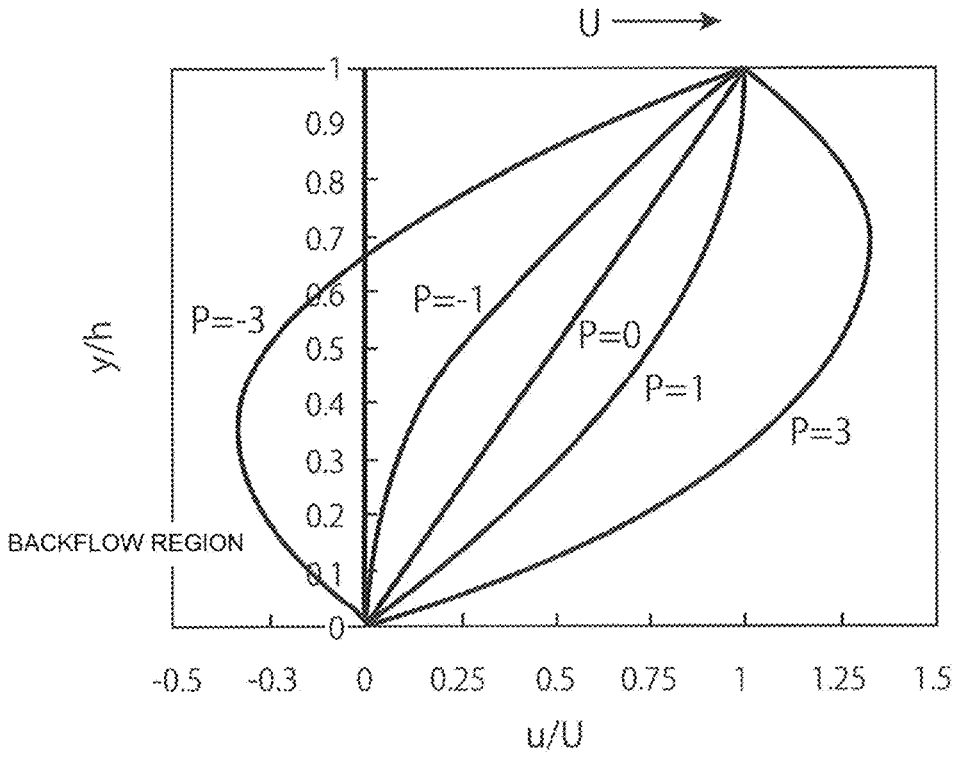

The above-mentioned gas backflow can be explained as follows. FIG. 12(*a*) shows a model for Couette-Poiseuille flow between parallel flat plates. First, a steady flow between two parallel flat plates is considered. One of the plates is stationary and the other is moving at a velocity of u. Thus, the Navier-Stokes equation is simplified, and the following expression (Expression 1) is obtained.

$$\frac{\partial p}{\partial x} = \mu \frac{\partial^2 u}{\partial y^2} \quad \text{[Math. 1]}$$

Here, in Expression 1, u is a function of y only, and p is a function of x only. Thus, Expression 1 can be expressed as an ordinary differential equation (Expression 2).

$$\frac{dp}{dx} = \mu \frac{d^2 u}{dy^2} \quad \text{[Math. 2]}$$

The boundary conditions are y=0: u=0, y=h: u=U.

The solution can be easily obtained by integration and expressed by the following expression (Expression 3).

$$u(y) = U\frac{y}{h} + \frac{h^2}{2\mu}\left(-\frac{dp}{dx}\right)\left[\frac{y}{h}\left(1-\frac{y}{h}\right)\right] \quad \text{[Math. 3]}$$

This solution is a superposition of a simple shear flow (first term, Couette flow) and a parabolic velocity profile (second term, Poiseuille flow).

Dividing both sides of Expression 3 by U gives the following expression (Expression 4).

$$\begin{aligned} \frac{u(y)}{U} &= \frac{y}{h} + \frac{h^2}{2\mu U}\left(-\frac{dp}{dx}\right)\left[\frac{y}{h}\left(1-\frac{y}{h}\right)\right] \\ &= \frac{y}{h} + \frac{h^2}{2\mu U}\left(-\frac{dp}{dx}\right)\left[\frac{y(h-y)}{h}\right] \\ &= \frac{y}{h} + \frac{h^2}{2\mu U}\left(-\frac{dp}{dx}\right)[y(h-y)] \end{aligned} \quad \text{[Math. 4]}$$

Here, the shape changes depending on the positive or negative sign of the dimensionless pressure gradient (Expression 5) of the second term on the right side of Expression 4. As shown in the graph of FIG. 12(*b*), when P is less than −1, a backflow part is present in which u/U is negative.

$$P = \frac{h^2}{2\mu U}\left(-\frac{dp}{dx}\right) \quad \text{[Math. 5]}$$

As can be identified from Expressions 4 and 5, a larger h increases the backflow component. In other words, it can be considered that a greater flow passage depth tends to increase the possibility of backflow.

As described above, according to the turbomolecular pump 100 of the present example, the flow passage depth of the groove exhaust mechanism portion is continuously constant (H2) from a middle section of the Siegbahn type exhaust mechanism portion 201 to the outlet of the Holweck type exhaust mechanism portion 301. This achieves excellent back pressure characteristic as shown in FIGS. 8(*a*) and 8(*b*). As a result, the present example can provide the turbomolecular pump 100 with excellent exhaust performance.

Moreover, as shown in FIGS. 5 and 6(*a*), the Siegbahn type exhaust mechanism portion 201 and the Holweck type exhaust mechanism portion 301 are continuously formed in the groove exhaust mechanism portion. The Siegbahn type exhaust mechanism portion 201 and the Holweck type exhaust mechanism portion 301 form an exhaust flow passage in the groove exhaust mechanism portion. As such, as compared to a configuration that includes only one of the Siegbahn type exhaust mechanism portion 201 and the Holweck type exhaust mechanism portion 301, a long exhaust flow passage can be easily ensured. This also contributes to provide the turbomolecular pump 100 with excellent exhaust performance.

Furthermore, in the Siegbahn type exhaust mechanism portion 201, a plurality of flow passages (flow passages of the first Siegbahn type exhaust mechanism to the fourth Siegbahn type exhaust mechanism) are spatially connected via the turning portions 286 and 287 to form the Siegbahn exhaust flow passage 291. The Siegbahn type exhaust mechanism portion 201 has a meandering flow passage as shown in FIGS. 5 and 6(*a*). Thus, the long Siegbahn exhaust flow passage 291 can be easily ensured. This also contributes to provide the turbomolecular pump 100 with excellent exhaust performance.

There may be a possibility that the presence of the turning portions 286 and 287 causes backflow or stagnation of the gas, resulting in a decrease in performance. However, since the gas flow passage is lengthened as much as possible, it is assumed that backflow and stagnation are prevented as much as possible. Also, at the turning portions 286 and 287, due to the drag (drag force) effect acting when the gas flows, a pressure drop does not occur, or a pressure drop is not excessive, if any.

As shown in FIGS. 5 and 6(*a*), the Holweck exhaust flow passage 321 in the Holweck type exhaust mechanism portion 301 is formed to have an L-shaped cross section. As such, as compared to a configuration that has an exhaust flow passage only on the inner circumference surface 306 of the threaded spacer 131, the exhaust flow passage can be extended by the length of the Holweck spiral groove portion 304. This also contributes to provide the turbomolecular pump 100 with excellent exhaust performance.

Furthermore, in the present example, as shown in FIGS. 5 and 6(*a*), the groove exhaust mechanism portion is in the stage following (downstream of) the turbomolecular pump mechanism portion, which includes the rotor blades 102 (102*a*, 102*b*, 102*c*, . . . ), the stator blades 123 (123*a*, 123*b*, 123*c*, . . . ), and the like, and is formed so as to be spatially continuous with the turbomolecular pump mechanism portion. As a result, a longer exhaust flow passage can be easily formed by the groove exhaust mechanism portion and the exhaust flow passage of the turbomolecular pump mechanism portion. This also contributes to provide the turbomolecular pump 100 with excellent exhaust performance.

The turbomolecular pump 100 of the present example may also be described as follows. When a long gas flow passage is ensured as in the turbomolecular pump 100, provided that the opening width and depth are common, the capacity of the space for the flow of gas (the space that contains gas per unit time) generally increases. This is considered to be one of the reasons that ensuring a long gas flow passage improves the back pressure characteristic.

That is, as indicated by broken line W1 in FIG. 11(*a*), when the flow passage depth changes from the inlet to the outlet of the groove exhaust mechanism portion, the exhaust performance relating to "exhaust speed" and "compression performance" can be improved as described above. However, as for the "back pressure characteristic", ensuring a long flow passage alleviates the influence of changes in the flow passage depth from the inlet to the outlet of the groove exhaust mechanism portion. According, a longer flow passage length of the groove exhaust mechanism portion can moderately improve the exhaust performance, resulting in satisfactory "back pressure characteristic".

It is also conceivable that one of the factors behind the excellent back pressure characteristic as shown in FIGS. 8(*a*) and 8(*b*) is that the ultimate pressure is kept low by the Siegbahn spiral groove portions 262*a* (the inlet portion of the groove exhaust mechanism portion) serving as the inlet portion of the groove exhaust mechanism portion.

That is, the ultimate pressure is a factor concerning the compression ratio, and, in general, the higher the compression ratio, the lower the ultimate pressure. Providing the Siegbahn spiral groove portions 262*a* as the inlet portion of the groove exhaust mechanism portion allows the opening of the inlet portion to be larger than the constant value (H2) of depth, increases the compression ratio, and keeps the ultimate pressure low.

It is also conceivable that one of the factors behind the excellent back pressure characteristic as shown in FIGS. 8(*a*) and 8(*b*) is that the turning portions 286 and 287 are formed in the Siegbahn exhaust flow passage 291, in addition to that the flow passage depth is constant (H2) and that the opening of the inlet portion of the Siegbahn spiral groove portion 262*a* is large.

That is, it is conceivable that the pressure distribution at the turning portions 286 and 287 in the above configuration advantageously allows the gas in the Siegbahn exhaust flow passage 291 to be less susceptible to stagnation or backflow.

Stagnation and backflow of gas can lower the exhaust performance. Causes of stagnation (such as local stagnation in the flow passage) include a reduced diameter (narrowing) of the flow passage and a decrease in conductance. Causes of backflow include a negative pressure gradient.

In the turbomolecular pump 100 of the present example, the Siegbahn exhaust flow passage 291 is formed in multiple stages that lie on top of one another in the axial direction (the axial direction of the rotor shaft 113) with the turning portions 286 and 287 interposed therebetween. Also, in the Holweck type exhaust mechanism portion 301, the Holweck exhaust flow passage 321 is formed to have an L-shaped cross section.

For this reason, even though the Siegbahn type exhaust mechanism portion 201 and the Holweck type exhaust mechanism portion 301 are arranged in the axial direction, the overall size (height dimension) of the turbomolecular pump 100 in the axial direction is limited as much as possible.

As for the Siegbahn spiral groove portion 262 and the Holweck spiral groove portion 304, it is desirable to select appropriate widths and areas of the flow passages because an excessively wide flow passage increases the possibility of backflow.

The present disclosure is not limited to the example of the present disclosure described above, and various modifications are possible. For example, the number of stator discs is not limited to two, and the number of rotating discs is not limited to three.

Also, the objects that include the ridges 261 or the groove portions 262 are not limited to the stator discs 219*a* and 219*b*, and may be the rotating discs 220*a* to 220*c*. Furthermore, it is possible to combine a stator disc and a rotating disc having ridges 261 or groove portions 262. For example, ridges 261 or groove portions 262 may be formed on one of the plate surfaces of a rotating disc and one of the plate surfaces of a stator disc. Also, ridges 261 or groove portions 262 may be provided only on one side facing a rotating disc of each of the upper and lower (upstream and downstream) stator discs on opposite sides of the rotating disc.

It should be noted that the present disclosure is not limited to the above-described examples, and various modifications can be made by the ordinary creative ability of those skilled in the art within the scope of the technical idea of the present disclosure.

The invention claimed is:

1. A vacuum pump comprising:

a Siegbahn exhaust mechanism in which a spiral groove is provided in at least one of a rotating disc and a stator disc; and a Holweck exhaust mechanism in which a helical groove is provided in at least one of a rotating cylinder and a stator cylinder, the Holweck exhaust mechanism being located on a downstream side of the Siegbahn exhaust mechanism, wherein the Holweck exhaust mechanism has a flow passage depth that is continuously constant at a predetermined depth, the Siegbahn exhaust mechanism includes a plurality of Siegbahn exhaust mechanisms in multiple stages, and a flow passage depth portion of a lowest stage Siegbahn exhaust mechanism from among the plurality of Siegbahn exhaust mechanisms is the same as a flow passage depth portion of the Holweck exhaust mechanism at the predetermined depth, the lowest stage Siegbahn exhaust mechanism connected to the Holweck exhaust mechanism.

2. The vacuum pump according to claim 1, further comprising, on an upstream side of the Siegbahn exhaust mechanism, a rotor blade including a blade row, and a stator blade located at a predetermined distance from the rotor blade in an axial direction.

* * * * *